US009334640B2

(12) United States Patent
Burt et al.

(10) Patent No.: US 9,334,640 B2
(45) Date of Patent: May 10, 2016

(54) CAGELESS DISPENSING DEVICE

(75) Inventors: Diane Joyce Burt, Montvale, NJ (US); Dalmacio T. Jugarap, Montvale, NJ (US)

(73) Assignee: Reckitt Benckiser LLC., Parsippany, NJ (US)

( * ) Notice: Subject to any disclaimer, the term of this patent is extended or adjusted under 35 U.S.C. 154(b) by 687 days.

(21) Appl. No.: 12/678,916

(22) PCT Filed: Sep. 15, 2008

(86) PCT No.: PCT/GB2008/003129

§ 371 (c)(1), (2), (4) Date: Apr. 15, 2010

(87) PCT Pub. No.: WO2009/037431

PCT Pub. Date: Mar. 26, 2009

(65) Prior Publication Data

US 2010/0192291 A1 Aug. 5, 2010

(30) Foreign Application Priority Data

Sep. 21, 2007 (GB) ..... 0718420.3

(51) Int. Cl.
*E03D 9/02* (2006.01)
*E03D 9/00* (2006.01)

(52) U.S. Cl.
CPC ..... *E03D 9/022* (2013.01); *E03D 9/007* (2013.01); *E03D 2009/024* (2013.01)

(58) Field of Classification Search
CPC ..... E03D 9/005; E03D 9/007; E03D 9/032; E03D 2009/024
USPC ..... 4/222, 223, 231, 227.5; 422/122
See application file for complete search history.

(56) References Cited

U.S. PATENT DOCUMENTS

| | | | | |
|---|---|---|---|---|
| 104,077 | A | 6/1870 | Strausbourgh, Jr. | |
| 668,717 | A | 2/1901 | Rowell et al. | |
| 849,978 | A | 4/1907 | Cox | |
| 886,791 | A * | 5/1908 | Gaines | 4/231 |
| 1,067,472 | A * | 7/1913 | Creed | 4/231 |
| 1,815,197 | A | 7/1931 | Gamel et al. | |
| 1,974,955 | A | 9/1934 | Anestis | |
| 2,011,732 | A | 8/1935 | Saeks | |
| 2,985,377 | A | 3/1961 | Saeks | |
| 2,984,841 | A | 5/1961 | Wilson | |
| 3,088,126 | A * | 5/1963 | Klingler | 4/231 |
| 3,217,338 | A | 11/1965 | Wilson | |
| 3,290,699 | A | 12/1966 | Weinstein | |
| 3,604,021 | A | 9/1971 | Nolte, Jr. | |

(Continued)

FOREIGN PATENT DOCUMENTS

| | | |
|---|---|---|
| AT | 293965 B | 11/1971 |
| CH | 675140 A5 | 8/1990 |

(Continued)

OTHER PUBLICATIONS

English Language Abstract for AT293965 taken from esp@cenet.com.

*Primary Examiner* — Lauren Crane
*Assistant Examiner* — Erin Deery
(74) *Attorney, Agent, or Firm* — Norris McLaughlin & Marcus PA

(57) ABSTRACT

The present invention relates to improved toilet dispensing devices for use in conjunction with a sanitary appliance particularly a toilet.

21 Claims, 6 Drawing Sheets

(56) References Cited

U.S. PATENT DOCUMENTS

Figure 1:
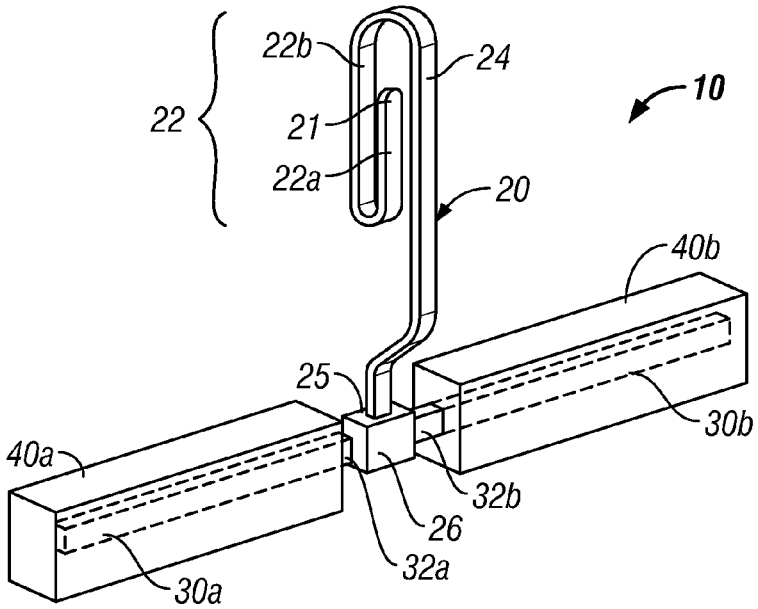

| | | | | |
|---|---|---|---|---|
| 3,668,717 | A * | 6/1972 | Curran | 4/231 |
| 3,675,254 | A * | 7/1972 | Brownstein | 4/231 |
| 3,691,354 | A | 9/1972 | Green et al. | |
| 3,694,354 | A * | 9/1972 | Nolte | 210/631 |
| 3,943,243 | A | 3/1976 | Kook | |
| 3,947,901 | A | 4/1976 | Willert | |
| 4,067,946 | A | 1/1978 | Rickert | |
| 4,320,033 | A | 3/1982 | Yoshikawa | |
| 4,460,490 | A * | 7/1984 | Barford et al. | 510/192 |
| 4,670,916 | A | 6/1987 | Bloom | |
| 5,206,959 | A | 5/1993 | Provenzano | |
| 5,449,473 | A | 9/1995 | Bunczk et al. | |
| 5,698,513 | A | 12/1997 | Schulz et al. | |
| 5,987,655 | A | 11/1999 | Smet | |
| 6,230,334 | B1 | 5/2001 | Camp et al. | |
| 6,517,761 | B2 | 2/2003 | Yoshida et al. | |
| 6,544,537 | B1 | 4/2003 | Mahaffey, Jr. et al. | |
| 6,651,261 | B1 * | 11/2003 | Leonard et al. | 4/231 |
| 6,654,971 | B1 | 12/2003 | Middleton | |
| 7,056,873 | B1 * | 6/2006 | Sidgwick et al. | 510/191 |
| 8,615,820 | B2 * | 12/2013 | Arora | A61L 9/05 4/231 |
| 8,966,674 | B2 * | 3/2015 | Lu | E03D 9/032 4/223 |
| 9,003,572 | B2 * | 4/2015 | Knorr | E03D 9/032 248/339 |
| 2002/0035049 | A1 * | 3/2002 | Suri et al. | 510/191 |
| 2006/0230576 | A1 | 10/2006 | Meine | |
| 2006/0246149 | A1 | 11/2006 | Buchholz et al. | |
| 2007/0039088 | A1 | 2/2007 | Nguyen et al. | |
| 2007/0092477 | A1 | 4/2007 | Cheung et al. | |
| 2007/0204389 | A1 * | 9/2007 | Graefe et al. | 4/231 |
| 2009/0119825 | A1 | 5/2009 | Wilson et al. | |
| 2009/0235443 | A1 | 9/2009 | Arora et al. | |

FOREIGN PATENT DOCUMENTS

| | | | | |
|---|---|---|---|---|
| CN | 1702240 | A | 11/2005 | |
| CN | 1813111 | | 8/2006 | |
| DE | 8906140 | U1 | 11/1989 | |
| EP | 0023059 | A1 | 1/1981 | |
| EP | 0879877 | A1 | 11/1998 | |
| EP | 1046755 | B1 | 10/2000 | |
| EP | 1048687 | A1 | 11/2000 | |
| EP | 1418225 | A1 | 5/2004 | |
| GB | 460041 | | 1/1937 | |
| GB | 813392 | | 5/1959 | |
| GB | 2287712 | A | 9/1995 | |
| GB | 2322632 | A | 9/1998 | |
| GB | 2338496 | A | 12/1999 | |
| GB | 2369377 | A | 5/2002 | |
| GB | 2407825 | A | 5/2005 | |
| GB | WO 2006/013321 | A1 * | 2/2006 | E03D 9/03 |
| GB | 2416784 | A | 8/2006 | |
| JP | 2003002733 | A | 1/2003 | |
| WO | 9316242 | A1 | 8/1993 | |
| WO | 9940169 | A1 | 8/1999 | |
| WO | 2005052110 | A1 | 6/2005 | |
| WO | 2006013318 | A1 | 2/2006 | |
| WO | 2007107750 | A1 | 9/2007 | |
| WO | 2007107755 | A1 | 9/2007 | |
| WO | 2007107769 | A1 | 9/2007 | |
| WO | 2007148054 | A1 | 12/2007 | |

* cited by examiner

CAGELESS DISPENSING DEVICE

This is an application filed under 35 USC 371 of PCT/GB2008/003129.

The present invention relates to improvements to a dispensing device. More particularly the present invention relates to a device used to deliver a treatment composition to a sanitary appliance, particularly to a toilet, which treatment composition contains one or more chemical constituents e.g., coloring agents, cleaning agents, disinfecting agents, anti-lime scale agents in the form of a block. The treatment composition is formed by water contacting the block of the device coming into contact with the one or more chemical constituents; the block provides for the long term release of the one or more active agents during sequential contacts with water contacting the block of the toilet dispensing device.

Since the advent of sanitary appliances and in particular modern flush toilets, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls.

One common approach known to the art is to provide a device which is at least immersed within the cistern or tank of a toilet, which may be either placed wholly within the interior of the toilet such as by placement at the bottom of a toilet tank so that the entire device is wholly immersed in water when the tank is full, or is at least partially immersed within the water present in a toilet tank, such as wherein such a device is suspended from a part of the toilet tank, such as a lip or rim of the tank. Such are generally referred to as ITC devices.

A further common approach known to the art is to provide a device which is suspended from the rim of the toilet bowl and which is placed at or near the interior sidewall of the toilet bowl. Such are generally referred to as ITB devices. Such a device is designed to typically dispense a treatment composition to the interior of a toilet when a gel or block compositions is contacted with flushing water, or alternately, dispensing a fragrancing composition to the toilet bowl which is intended to counteract or mask malodors. Typically such devices include a hanger portion which is used to suspend a cage portion from the rim of the toilet bowl, such that the cage portion is positioned within the path of flowing water which is dispensed with each flush operation of the toilet. The cage portion typically comprises a plurality of holes or apertures which permit for the flush water to both enter and to exit the cage portion of the device. Typically a solid block composition or a gel composition is present within the cage. The solid block composition and/or gel composition typically comprises one or more cleaning constituents, e.g., one or more surfactants which provide a good cleaning and/or foaming benefit. Often the solid block composition and/or gel composition comprises a fragrance constituent as well which is provided to provide some degree of malodor suppression. For most such devices, the use of a cage is essential as in the case of a gel compositions, as gels are not self supporting and would not be useful without the physical supporting structure provided by the cage. With regard to solid block compositions, such compositions are notoriously prone to weakening and softening over time and most are known to sell or sag over their lifetime, particularly when approaching the end of their useful service life. The cage acts then as a porous receptacle and support for said blocks which would otherwise prematurely soften or disintegrate and fall into the toilet bowl and be flushed away before their composition is substantially consumed.

While the use of a cage is beneficial, the use of a cage is not without attendant problems. The use of a cage requires increased material costs, and additional manufacturing steps. Further as such ITB devices are typically single use type devices, once the gel or block composition is consumed or otherwise exhausted, the consumer discards the entire ITB device which is wasteful and contributes to the problems associated with proper garbage disposal. With regard to costs, in most conventional rim suspended lavatory devices comprising a hanger portion and a cage portion, the bulk of the material is typically used to form the cage. As such cages are typically fabricated from a synthetic polymer, such requires specific molding operations in order to form the rim suspended lavatory device, and to fill the cage with the solid block composition and/or gel composition prior to use and or sale.

Known to the art are rim suspended lavatory devices which are lavatory blocks of paradichlorobenzene which provide no cleaning benefit, but provide only a fragrancing benefit. Such blocks typically erode per sublimation of the paradichlorobenzene and/or by contact with flush water. Such rim suspended are lavatory blocks of paradichlorobenzene are typically packaged as a solid block or cake having extending from one side a loop of bendable wire. A portion of the bendable wire is embedded within the paradichlorobenzene block. The consumer is required to form the wire into a hanger appropriate to the particular geometry of their toilet so that the paradichlorobenzene block is positioned with the interior of the toilet bowl.

Apart from the foregoing, while the elimination of a cage from a conventional, rim suspended lavatory device would be beneficial such are not believed to be known. This is due to the fact that surfactant containing solid block compositions are known to soften quickly and this in turn eliminates any reasonable prospect of a useful service life when used in conjunction with a toilet absent the support provided by the cage.

Thus, while certain known-art dispensing devices provide beneficial malodor treatment effects, there is nonetheless a real and continuing need in the art to provide still further improved devices which can provide to a sanitary appliance a useful treatment benefit, preferably a useful cleaning benefit.

The present invention, in its various aspects, provides a lavatory dispensing device useful for the delivery of at least one treatment composition, preferably a cleaning composition and/or a sanitizing composition to a sanitary appliance, e.g. a toilet bowl. The device can be used either as an ITC type device, or an ITB type device for a sanitary appliance such as a urinal, toilet tank or toilet bowl. In certain preferred embodiments the device according to the invention is used as an ITB type device. In certain alternate preferred embodiments the device according to the invention is used as an ITC type device.

According to a first aspect of the invention there is provided a cageless lavatory dispensing device comprising a hanger and a plurality of compressed solid blocks each of which comprises one or more chemical constituents for use with a sanitary appliance, preferably a toilet.

According to a second aspect of the invention there is provided a cageless lavatory dispensing device comprising a hanger having a hook end adapted to be suspended from a part of a sanitary appliance, particularly the rim of a toilet bowl comprising a plurality of compressed solid blocks each comprising at least one chemical agent adapted to be suspended within the interior of the sanitary appliance. The dimensions and configuration of the cageless lavatory dispensing device are such that the solid block comprising the one or more chemical constituents are preferably positioned within the path of flushing water which is released or dispensed by the sanitary appliance.

According to a third aspect of the invention there is provided a cageless lavatory dispensing device comprising a hanger having a part adapted to be suspended from a part of a sanitary appliance, and a plurality of compressed solid blocks comprising one or more chemical constituents, wherein the device is adapted to be suspended within the interior of the toilet bowl.

In accordance with a fourth aspect of the invention there is provided a cageless lavatory dispensing device comprising a hanger adapted to be suspended from the rim of a sanitary appliance, particularly a toilet bowl, and a plurality of blocks, each comprising at least one or more chemical constituents adapted to be suspended within the interior of the toilet bowl, wherein the block composition is long lasting.

According to a fifth aspect of the invention there is provided a process for delivering a treatment composition to a sanitary appliance, especially preferably, to the interior of a toilet bowl, which process comprises: providing a cageless lavatory dispensing device comprising a hanger adapted to be suspended from a part of a sanitary appliance, and a plurality of compressed blocks each comprising at least one or more chemical constituents adapted to be suspended within the sanitary appliance, and, periodically flushing water about the exterior of the compressed blocks to elute at least one chemical constituent to form a treatment composition with said water which treatment composition is used to treat a part of the sanitary appliance.

According to a sixth aspect of the invention there is provided a process for delivering a treatment composition to a to the interior of a toilet bowl, which process comprises: providing a cageless lavatory dispensing device comprising a hanger adapted to be suspended from a part of a toilet bowl, preferably the rim thereof, where the device further comprises a plurality of compressed blocks each individually comprising at least one chemical constituent, said compressed blocks adapted to be suspended within the interior of the toilet bowl, and, periodically flushing water about the exterior of the compressed blocks to elute or release at least one chemical constituent so to form treatment composition with the water which is used to treat at least the interior of the toilet bowl.

According to a seventh aspect of the invention there is provided a cageless lavatory dispensing device comprising a hanger having a part thereof adapted to be suspended from a part of a sanitary appliance, particularly from a part a toilet cistern or toilet tank, and a plurality of compressed solid blocks each comprising one or more chemical constituents, wherein the device is adapted to be suspended within the interior of said cistern or tank.

According to an eight aspect of the invention there is provided a process for delivering a treatment composition to a sanitary appliance, especially preferably, to the interior of a toilet cistern or toilet tank, which process comprises: providing a cageless lavatory dispensing device comprising a hanger adapted to be suspended from the rim of a sanitary appliance, particularly a part of a toilet cistern or toilet tank such as from a part of a rim of a toilet cistern or toilet tank, and at least two compressed solid blocks each comprising one or more chemical constituents adapted to be suspended within the said cistern or tank, and, periodically immersing the exterior of the compressed blocks in the water within the cistern or tank so to elute at least one chemical constituent from each of the compressed solid blocks to form a treatment composition with the water which is used to treat a part of the sanitary appliance.

According to a ninth aspect of the invention there is provided a process for delivering a treatment composition to a to the interior of a toilet bowl, which process comprises: providing a cageless lavatory dispensing device to the interior of a toilet cistern or tank comprising a hanger adapted to be suspended from a part of the toilet cistern or tank, preferably from a part of the rim thereof, where said device further comprises a plurality of compressed solid blocks each comprising at least one chemical constituent adapted to be suspended within the water within the cistern or tank so to elute at release at least one chemical constituent an to form a treatment composition therefrom which is used to treat at least the toilet cistern or tank, and preferably to also treat the interior of the toilet bowl when the treatment composition formed is used to flush the toilet bowl.

In accordance with a still further aspect of the invention there is provided as a vendible article, a cageless lavatory dispensing device comprising a hanger and a plurality of compressed solid blocks each comprising one or more chemical constituents for use with a sanitary appliance, particularly a toilet.

In accordance with a yet further aspect of the invention there is provided as a vendible article, a cageless lavatory dispensing device comprising a hanger having a standoff section and a plurality of compressed solid blocks depending from a support structure, each of said blocks comprising one or more chemical constituents for use with a sanitary appliance, particularly a toilet.

In accordance with a still further aspect of the invention there is provided as a vendible article, a cageless lavatory dispensing device comprising a hanger having a standoff section and a plurality of compressed solid blocks each comprising one or more chemical constituents for use with a sanitary appliance, particularly a toilet.

These and other aspects of the invention will be more evident from a reading of the following specification.

Broadly defined, the present invention provides a cageless lavatory dispensing device comprising a hanger and a plurality compressed solid blocks each comprising one or more chemical constituents for use with a sanitary appliance, as well as methods for its use of the cageless lavatory dispensing device in the treatment of sanitary appliances, particularly toilets.

The inventors have surprisingly found that notwithstanding the existing prejudice in the prior art which dictates the use of cages to support and contain lavatory treatment blocks, that it has been discovered by the inventors that it is now possible to fabricate cageless lavatory dispensing devices which comprise a hanger and a plurality of compressed solid blocks depending from a structure or hanger which blocks each comprise one or more chemical constituents useful in the treatment of a lavatory appliance, viz. a toilet bowl, said blocks preferably comprising at least a surfactant composition, which cageless lavatory dispensing devices are useful in providing a treatment composition to a sanitary appliance over repeated flushes of water and/or repeated immersions in water wherein the said blocks to not unreasonably prematurely fall away from or break away from the structure or hanger for a reasonable duration of time. This result is unexpected as the prior art dictates the use of a cage as previously described, and as is also widely known in the art to support a lavatory block over its useful lifespan, particularly wherein the lavatory block comprises one or more surfactants. As is known to the art, with repeated flushes of water, many such surfactant containing lavatory blocks tend to swell and/or soften and very frequently disintegrate or slump, thus requiring a cage to contain the lavatory block. Alternately as is known in the art, with long term immersion in water such as in a toilet cistern or toilet tank, such surfactant containing lavatory blocks tend to swell and/or soften and very frequently disintegrate or slump, thus requiring a cage to contain the lavatory block.

The inventors have discovered that cageless lavatory dispensing devices which comprise a hanger and plurality of compressed solid blocks, at least two of which include one or more chemical constituents, preferably at least a surfactant composition, which may be formed by a process which contemplates: (a) forming a mass comprising at least one or more chemical constituents; (b) compressing a quantity of the mass to encase a portion of the a structure or hanger. Optionally but preferably, the mass comprising the at least one or more chemical constituents is mixed and extruded into a preform shape, thereafter a portion of the hanger is inserted into the preform shape or between a plurality of preform shapes, and subsequently the perform shape(s) are compressed in a die to provide the final form of the compressed solid blocks of the cageless lavatory dispensing device. The compressed solid blocks are retained without the need of an enclosing cage, as well as without the need of any separate adhesive material or composition which is placed between the compressed solid block and the part of the structure or hanger which the compressed solid block contacts.

In its simplest form the structure or hanger is merely an article which comprises at one end, a hook end which is adapted to or configured to suspend the hanger from a part of a sanitary appliance. The hanger is preferably configured so to permit its use either as an ITB device or as an ITC device. The hanger may include a support structure such as a rod, bar or plate, which is adapted to be embedded within each of the compressed solid block compositions. The hanger may also include a standoff section. Quite frequently the hanger includes an intermediate stalk connecting the hook end with the support structure, e.g., rod, bar or plate. The hanger itself may be a single element of a unitary construction, or alternately, may be formed from a plurality of elements which are adapted to be linked or connected together. When the hanger is formed from two or more such discrete elements, the individual elements can be affixed, attached, or linked together to ultimately form the hanger of the invention.

The cageless lavatory dispensing device of the invention may be provided as a multiple-use article, wherein the consumer retains a part said device on the sanitary appliance, but replaces a part of the said device periodically as may be needed. In such a configuration, usually a part of the hanger is retained and reused by a consumer, but upon consumption of the compressed solid blocks, new compressed solid blocks on a support structure may be provided to the sanitary appliance where it may be removably affixed to the retained part of the cageless lavatory dispensing device. Most conveniently however the hanger is a single piece article.

With regard to the hook end, it is to be understood that the hook end of the hanger can be of any configuration which is suitable to provide a hook-type support for suspending the support structure on from which depend the plurality of compressed solid blocks within the interior of a sanitary appliance. Ideally, the hook is configured such that it is adapted to be suspended over at least a part of the rim of sanitary appliance. Such may be a rim of a urinal, a toilet bowl, or toilet cistern or tank. The hook may be of any suitable dimension, and as it is understood that as the configuration and geometry of sanitary appliances vary, naturally the hook can be adapted to suit the particular dimensional or geometric configurations of toilets. Alternately and preferably the hook end is flexible and configurable to adapt to various configurations and geometries so that it may be used with different sanitary appliances. Typically however, the hook end may be configured into a "U" shaped portion of the hanger such that it may be used to suspend the hanger and plate bearing the compressed solid block composition.

The hook may be provided in a rigid, preformed configuration which is non-flexible or only sparingly flexible in order to accommodate the dimensions of the hook to a particular sanitary appliance. For example wherein the hook is provided as a rigid, preformed configuration to be used in suspending the cageless lavatory dispensing device in an ITC application the hook may be a discrete element which is dimensioned to have a cross-section which in adapted to accommodate a part of the upper rim or edge of a toilet cistern or toilet tank. Such a hook may merely suspend the device on the rim, or the hook may be configured so that when applied to the part of the upper rim or edge of a toilet it functions as a mechanical clip such that it is generally retained at its point of installation and resists accidental misplacement or movement. Additionally or alternately such a hook may further include a connector means which may be one or more elements which may take any physical shape or form and which is configured to cooperatively connect with a the remaining element or elements of the cageless lavatory dispensing device so that said remaining element or elements may be removably affixed to such a hook. In such manner, the hook may be retained although the remaining elements, viz., the support structure such as a rod, bar or plates bearing the compressed blocks may be replaced a number of times once the compressed blocks are exhausted. Any suitable mechanical or chemical fastener means may be used to provide such a function. By way of non-limiting example may be used any of a number of cooperating mechanical elements such as clips, hook-and-loop fasteners, pins, springs, elastic bands, loops, eyelets as well as chemical means including adhesives such as light or medium duty adhesives may be used as the fastener means. Other fastener means not elucidated herein but known to the art may also be used. In one preferred embodiment the hook includes a part which includes a mortise shaped element, which cooperates with the stalk or plate which is configured as a cooperating tenon which is removably insertable into the mortise shaped element, and from which the support structure depends. In another preferred embodiment the hook includes a peg or hook, and the stalk or plate includes a cooperating loop or eye from which the support structure bearing the compressed blocks may be suspended. The use of such two-part embodiments of the inventive cageless lavatory block is in certain embodiments of the invention preferred as such provide a great deal of flexibility and also permits for the reuse of at least one element of the cageless lavatory dispensing device multiple times without requiring replacement of the complete cageless lavatory dispensing device when a compressed lavatory blocks are exhausted. Thus is certain embodiments, certain elements of the cageless lavatory dispensing device may be reused, while others are intended to be single-use elements.

Conveniently however, the hook end is provided as one or more articulated elements which can be flexed or bent from a first or a "folded" configuration to a second or "open hook" configuration. It is to be understood that according to preferred embodiments, in order to minimize the volume of the hanger and in particular the hook end thereof, the hanger may be provided in a collapsed or folded configuration when placed into a package. Upon opening of the package, the consumer is then expected to easily unfold, extend, or otherwise stretch a portion of the hanger in order to form the hook end. A further important advantage is that the degree of flexibility provided into the hanger in order to provide for such a foldable and unfoldable hook end also introduces a degree of tension when the hook end is configured to be hung upon a sanitary appliance, and in particular the rim of a urinal, a toilet tank or cistern, or the rim of a toilet bowl. In such a configuration, the tension actually aids in the gripping of the hook upon the portion of the sanitary appliance upon which it is originally positioned by the consumer. Such tension reduces the likelihood of lateral movement or translation from its initial placement by a consumer unless desired by the consumer. Thus, specific placement of the cageless lavatory dispensing device, and a reasonable expectation that it will be retained at or near the position in which it was originally installed by a consumer relative upon a sanitary appliance is provided. Furthermore, the tension provided also provides for a degree of resiliency and also aids in the positioning of the compressed solid block at, or near, a specific part of the sloping interior wall of a sanitary appliance, e.g., a toilet bowl. Such can be beneficially particularly due to the fact that flush water from the toilet bowl typically exits from beneath the rim. Utilizing the tensile property of the hanger, the continuous positioning of the compressed solid blocks within the path of the flowing flush water is assured under most circumstances.

As has been noted above, in certain preferred embodiments and indeed, according to most preferred embodiments a stalk exists to connect the hook end with the a support structure from which the plurality of compressed solid blocks may depend. The stalk itself may be of any dimension or length, however when used in an embodiment of the invention wherein the device is an ITC type device, desirably the stalk is of sufficient length to ensure that the compressed blocks present on the support structure will be at least partially immersed, but preferably wholly immersed, in the water present in the toilet tank or cistern between flushes. When the stalk is used in an ITB type device, advantageously once the hook end is suspended upon a sanitary appliance, particularly the rim of a toilet bowl, the stalk extends a sufficient length to the support structure such that ultimately, the positioning of the hook and the length of the stalk as such that the compressed solid blocks present in the device are positioned in the path of the flush water. Again, the dimensions and in particular the length of the stalk can be varied in order to meet the specific requirements of a specific configuration of a sanitary appliance, particularly in the case of a toilet bowl, the distance from the top of the rim downwardly into the interior of the toilet bowl, or in the case of a cistern or tank, the distance from the top of the rim of the tank or cistern downwardly such that the plate intersects or is beneath the waterline of the water present in the tank or cistern between flushes. For example, when used as an ITB device, in toilets typically found in use in North America, the interior sloping walls of the toilet bowl are typically of a smaller and a more circular radius, thereby providing a "shallower" distance between the top of the rim of the toilet bowl, and the sump or water outlet at the bottom of the toilet bowl. In such a circumstance, a shorter stalk length is typically adequate in order to ensure that the compressed solid blocks on the support structure are placed within the path of the flush water. In European toilets, typically, the configuration of the toilet bowl and its sloping walls are usually in the form of a more frusto-conical configuration, thus providing a "deeper" toilet bowl as measured from the rim to the top level of the water in the sump. In such configuration, frequently, a longer stalk length then would be required for a North American toilet is typically preferred. Of course, different configurations of other toilet bowls are contemplated as well.

The device of the invention may include one or more hangers and/or one or more hooks as parts thereof.

The hanger is desirably used to support a support structure bearing the compressed solid block composition, and accordingly part of the support structure is adapted to be embedded and/or enrobed within the compressed solid blocks. However while a hanger, support structure and stalk have been discussed individually it is to be understood that single element may fulfill both the functions of the hanger and the support structure and discrete elements are not required. Additionally a stalk may be omitted in certain embodiments of the invention, which in other preferred embodiments a stalk is advantageously present between the hanger and a support means. The stalk may also be integrally formed with the hanger and/or the stalk may be integrally formed with the support structure from which the plurality of compressed solid blocks depend.

A support structure, when provided, is adapted to be embedded and/or enrobed within the compressed solid block composition. The support structure itself advantageously at the end distal to the hook end of the hanger and typically may be integrally formed with the hanger and/or the stalk or both, or where a stalk is not provided, may be integrally formed with the hanger. Alternately in certain preferred embodiments the support structure is separate from the hanger, but can be affixed thereto by a suitable connector means. Such connector means include those discussed previously and may be any element or other means by which the support structure can be affixed, preferably removably affixed to a part of the hanger. Thus, the support structure may be one or more separate element which may interconnected with or affixed to part of the hanger in order to define a particular configuration for the device of the invention. For example the support structure may be one or more support structures each of which bears at least one compressed solid block thereon and which includes a part thereof, or an element which is used to affix the support structure to part of the hanger.

The support structure may be of any useful configuration, but desirably, the support structure is dimensioned such that it is partially encased by the compressed solid block compositions. The support structure can may be one or more elements such as rods or tubes, which depend from and extend outwardly from at least the hanger, or from the stalk. Preferably the support structure depends from and extends outwardly from the hanger and/or stalk such that the support structure extends generally perpendicularly to the hanger and/or stalk. The support structure may be a rigid article or element or may be a flexible article or element or may include one or more flexible parts or elements, such as a so-called 'living hinge' or may include a mechanical element or elements which provide some degree of flexibility and/or movement of a support structure with respect to a hanger and/or stalk.

Conveniently, the support structure is generally of a flat, generally linear or generally planar configuration with a square or rectangular cross section, e.g., a plate or bar, and desirably has a generally uniform thickness along its length, or is circular in cross section of a uniform, e.g., a wire or rod. However, it is also contemplated that the support structure may include regions of diminishing thickness i.e. such as tapered sections or margins at or near the boundaries of the support structure.

The support structure itself need not necessarily be limited to a generally linear, and/or generally two-dimensional configuration, but may include elements or sections which extend outwardly from surfaces therefrom, such as in the form of one or more pegs, studs, pins, fins, rods, loops or the like which might be useful in providing further physical support between the support structure, and the compressed solid block compositions at least partially encasing it. Alternately, the support structure may include one or more perforations passing therethrough whereby, upon compression adjacent portions of the solid block compositions meet and pass through one or more perforations which may be provided within the support structure.

Alternately, the support structure may be one or more elements such as rods or tubes, which depend from and extend outwardly from at least the hanger, or from the stalk. The thickness of the support structure is preferably between 0.05-3 mm thick, preferably between 0.1 and 2 mm thick, and most preferably between 0.25 and 1.5 mm thick. Preferably the support structure is of a generally uniform in thickness (or radius) with at least 90%, preferably at least 95% of its surface being of a constant thickness with a variance of not more than +/−5%.

Optionally but in certain embodiments necessarily, the hanger of the invention also includes a standoff element. The standoff element may conveniently be a formed section of the hanger and/or stalk and/or support structure such that the standoff element is an integral part thereof. Alternately the standoff element may be a discrete element or discrete part of the hanger, preferably a part of the stalk when present in a hanger according to the invention. The standoff element may be provided preassembled or pre-affixed to the stalk or may require that such be attached by a user or consumer. The hanger standoff element may be positioned or located anywhere on the hanger, but is preferably located between the hook and the compressed treatment blocks. Advantageously the hanger standoff element is positioned or located such that with respect to the total length of the hanger as measured from the end of the hook end, to the distal end of the hanger, the standoff element is within the lower half of this length. Preferably the standoff element is within the lower 40% of the distance, more preferably is within the lower 33% of this distance.

Referring again to the standoff element, in embodiments of the hanger which comprise a standoff element, the standoff element is suitably dimensioned such that it is adapted to extend from the stalk or other part of the hanger in a direction rearwardly of the stalk, that is to say, in the direction which is coincident with the direction of the hook end relative to the stalk. Thus, when the cageless lavatory device is mounted on the rim of a toilet bowl or on the rim of a toilet cistern or toilet tank, the standoff element extends in generally the same direction as the hook end. Desirably this direction is also generally perpendicular, viz., 90°, +/−15°) relative to the plane defined by the plate, where such a plate is also present as part of the hanger. The standoff element has a height dimension at which is forms a peak point which is the maximum distance from which it extends from the hanger, preferably the stalk. Desirably the height of the standoff element is such that when the cageless lavatory dispensing device is initially installed in a sanitary appliance, the height of the standoff element is sufficient to impede some physical contact between the compressed solid blocks and a sidewall or other part of a sanitary appliance adjacent to the said blocks, and/or when the said blocks are partially eroded due to dissolution or other cause the height of the standoff element is sufficiently great such that the peak point of the standoff element contacts the sidewall or other part of the sanitary appliance and acts to lift the compressed solid blocks such that a gap is formed between the said sidewall or other part and the solid blocks. In certain embodiments, such occurs when less than 50% of the total mass of the compressed solid blocks, preferably when less than 65% of the compressed solid blocks are eroded or dissolved. The formation of such a gap, particularly prior to the substantial erosion of the compressed solid blocks is surprisingly advantageous from several technical perspectives. First, the formation of such a gap permits for the composition of the compressed solid blocks to be out of contact with a wet sidewall between flush cycles when the cageless lavatory device is used in a toilet bowl. Such improves the service life of the compressed solid blocks. Second, when the compressed solid blocks include a surfactant constituent, and is spaced-apart from the sidewall of a toilet bowl, during the flush cycle improved foam formation is observed to occur. While not wishing to be bound by the following the inventors believe that the gaps between the surface of the compressed solid blocks suspended on the hanger and the adjacent sidewall of the toilet bowl provides for some cavitation and air entrainment within this gap space during the flushing operation. Such is believed to improve the formation of bubbles and a more visible foam. Preferably the gap between the surface of the compressed solid blocks suspended by one or more part of the device or the invention and the adjacent sidewall of the sanitary appliance should be in the range of from 0.1 mm-10 mm, preferably 0.1-7 mm, still more preferably 0.2-5 mm, and most preferably 0.2-3 mm at the closest point between the blocks' surface and the adjacent sidewall.

While it is understood that various configurations and geometries of the compressed solid blocks, as well as various configurations and geometries of the hanger and standoff element are possible, it is nonetheless preferred that the relative dimensions of these elements is such that when the cageless lavatory dispensing device which includes a standoff element is formed but has not been put into service, when the said device is laid upon a flat horizontal surface, the standoff element has a sufficient height such that the peak point is sufficient to raise at least a part of the rearward face of the compressed solid blocks from contacting the horizontal surface. Preferably as well, after the lavatory dispensing device is put into service and installed in a sanitary appliance, preferably a toilet bowl and at least 50% of the mass is eroded, desirably the height of the standoff element is sufficient that the peak point contacts the surface of the sanitary appliance adjacent to the compressed solid blocks and is sufficient to cause a gap of at least 0.2 mm, preferably a gap of between 0.2 and 5 mm between the closest point between the blocks' surface and the adjacent sidewall.

The hanger, and where present, the stalk and the a standoff element, whether provided as a single unitary piece or assembled from a composite of discrete pieces or elements, may be formed from any of a variety of materials which can be used for the purpose described herein. Exemplary and preferred materials include metals including wires or rods which are bendable and are preferably coated with flexible non-metallic material such as a flexible polymer, a paint or a sheath, as well as one or more synthetic polymers which are preferred. Preferably the hanger may be formed of any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Preferably the material of construction is at least somewhat flexible. As to the material of construction of the hanger, the only criteria being that the selected materials used to fabricate the hanger is not deleteriously affected by the chemical constituents of the compressed solid block composition with which part of the hanger, viz., the plate and possibly part of the stalk. contacts.

The dispensing devices according to the invention may optionally include an air treatment dispenser which may be an article or element which forms part of the dispensing device of the present invention. The air treatment dispenser may be affixed to or form part of the hanger and provides for the release of a fragrance or other air treatment composition to the ambient environment of a toilet or other lavatory appliance, e.g. a lavatory or bathroom. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

In addition to a fragrance or in place thereof, the air treatment dispensers may be used to deliver one or more further compositions or constituent which provide a further or different air treatment benefit. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard According to certain preferred embodiments of the invention, the fragrance composition or other air treatment composition is associated solely with the air treatment dispenser of the invention. In this preferred that such an air treatment dispenser containing a fragrance composition or other air treatment composition be positioned with respect to a sanitary appliance, particularly a toilet bowl, such that the air treatment dispenser does not come into contact with water during the useful life of the device. This provides several simultaneous benefits including, the longevity of the fragrance composition, the improved delivery characteristic of the fragrance composition which does not become submerged or diluted with water associated with the sanitary appliance, as well as the fact that a much broader range of fragrance compositions (or other air treatment compositions as noted above) can be utilized as, there is no concern regarding the compatibility of fragrance with the materials in the compressed solid block composition. Furthermore, the utilization of the fragrance composition solely in conjunction with the air treatment dispenser also provides a constant release of the fragrance composition to the ambient environment of the sanitary appliance even when the sanitary appliance is not being the used. In the case where pleasant fragrance and/or odor masking composition is provided in the fragrance composition, a beneficial consumer perception of the use of the products can be realized. Alternately, where a sanitizing agent and/or an insecticidal agent is utilized as all or part of the fragrance composition of the air treatment dispenser, the continual benefits of continuous release of such agency may be provided. Advantageously the air treatment dispenser may be affixed to or form part of the hanger, preferably either on part of the stalk such that the air treatment dispenser faces the interior of the toilet bowl or other sanitary appliance or alternately the air treatment dispenser may be affixed to or form part of the hook end, preferably on a part thereof such that the air treatment dispenser is positioned on the exterior of the toilet bowl or other sanitary appliance. Alternately the air treatment dispenser may be an article which is removable from the hook end, such as wherein the hook end includes a fastener component and the air treatment dispenser includes a complimentary fastener component which provides means to affix the air treatment dispenser to the hanger. By way of non-limiting example, fastener components include, but are not limited to: hook-and-loop type fasteners (VELCRO®), clips, pins, snaps, adhesive strips, screw type fasteners as well as hook and eye type fasteners which may provide for removal of a replacement of the air treatment dispenser. By way of non-limiting example fastener components providing a permanent connection between the air treatment dispenser and the hanger include adhesives, spot welds, pins, rivets, screw-type fasteners and of course the air treatment dispenser may be integrally formed as part of the hanger.

The form of the fragrance composition or other air treatment composition provided in the air treatment dispenser can take any form including, liquid, solid, or gel form. Advantageously fragrance composition or other air treatment composition is provided as one or more of: a gel contained in a cavity, such as part of the air treatment dispenser or a removeable tray; a bottle or vessel which comprises a wick having one end extending into its interior which contains a quantity of the fragrance composition or other air treatment composition and the other end of said wick being exposed to the exterior of the bottle or vessel and into the ambient environment of the toilet or lavatory appliance; a canister or container such as a pressurized aerosol container or a pump supplied with a non-pressurized vessel or container, said container containing a quantity of the fragrance composition or other air treatment composition which may be manually dispensed by a consumer to the ambient environment of the toilet or lavatory appliance; as well as a film, sheet or fibrous pad or other porous substrate which contains a quantity of a fragrance composition or other air treatment composition which volatilizes into the ambient environment of the toilet or lavatory appliance. Preferably however, the fragrance composition or other air treatment composition is a gel system which is then deposited in a chamber or cavity present in the air treatment dispenser. The gel system can be formed by a variety of components known to those of ordinary skill in the art. For example, it can be formed from absorbents, starch based systems, modified celluloses, natural gums and other materials which can form a gel when the fragrance composition, aforementioned gel components, and water or hydrophilic solvents are mixed together. According to certain particularly advantageous embodiments of the invention the fragrance composition is a gel system as it is described in U.S. Pat. No. 5,780,527, the contents of which are hereby incorporated by reference.

The lavatory dispensing devices according to the invention necessarily also comprise a plurality of compressed solid blocks comprising at least one or more chemical constituents such that when the block is immersed, rinsed or washed with water, said chemical constituents are eluted or dissolved into said water and forms a treatment composition which is useful in treating a sanitary appliance, and particularly a toilet tank or cistern or a toilet bowl. Such a treatment composition may provide a cleaning and/or sanitizing and/or disinfecting benefit to the toilet or other sanitary appliance being treated with the devices of the invention.

As chemical constituents the compressed solid blocks may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the compressed solid blocks of the invention. While the device of the invention necessarily requires a plurality of compressed solid blocks, each comprising at least one or more chemical constituents it is to be understood that the chemical compositions of the two or more compressed solid blocks present may be the same or may be different from one another.

The solid blocks composition of the invention desirably comprises a surfactant constituent which may be one or more detersive surfactants. Exemplary useful surfactants include anionic, nonionic, cationic, amphoteric, and zwitterionic surfactants, particularly those whose melting points are sufficiently high, above about 110° F., preferably above 125° F., to permit processing according to known art techniques. However, small amounts of low melting point surfactants and even liquid surfactants may be used in providing the surfactant constituent.

Exemplary useful anionic surfactants which may be used in the compressed solid block compositions of the invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in practicing the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); paraffin sulfonate surfactants having the general formula $RSO_3$ M, wherein R is a primary or secondary alkyl group containing from about 8 to about 22 carbon atoms (preferably 10 to 18 carbon atoms) and M is an alkali metal, e.g., sodium, lithium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium β-acetoxy- or β-acetamido-alkanesulfonates where the alkane has from 8 to 22 carbon atoms.

A preferred class of anionic surfactants are linear alkyl benzene sulfonate surfactant wherein the alkyl portion contains 8 to 16 carbon atoms, and most preferably about 11 to 13 carbon atoms. According to particularly preferred embodiments of the invention, the solid block compositions necessarily include an anionic surfactant.

A further preferred class of anionic surfactants are alpha olefin sulfonates, as well as salts thereof, e.g., alkali metal salts. Preferred are $C_8$ through $C_{22}$ alpha olefin sulfonates, particularly $C_{12}$ through $C_{18}$, and especially $C_{14}$, and $C_{16}$ alpha olefin sulfonates as well as blends of two or more thereof. According to particularly preferred embodiments of the invention, the solid block compositions necessarily include an alpha olefin sulfonate anionic surfactant.

The detersive surfactant constituent of the solid block compositions of the invention may include one or more nonionic surfactants. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. Further, the length of the polyethenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_8$-$C_{10}$ straight-chain alcohol having an average molecular weight of 356, an ethylene oxide content of about 4.85 moles (about 60 wt. %), and an HLB of about 12; Alfonic® 810-2, which is described in product literature as a $C_8$-$C_{10}$ straight-chain alcohols having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6,5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Exemplary useful nonionic surfactants include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® such as Tergitol 15-S-12 which is described as being $C_{11}$-$C_{15}$ secondary alkanol condensed with 9 ethylene oxide units, or Tergitol 15-S-9 which is described as being $C_{11}$-$C_{15}$ secondary alkanol condensed with 12 ethylene oxide units per molecule.

A further class of useful nonionic surfactants include those surfactants having a formula:

$$RO(CH_2CH_2O)_nH$$

wherein;

R is a mixture of linear, even carbon-number hydrocarbon chains ranging from $C_{12}H_{25}$ to $C_{16}H_{33}$ and n represents the number of ethoxy repeating units and is a number of from about 1 to about 12.

Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3,24-L-45, 24-L-50, 24-L-60, 24-L-60N, 24-L-75, 24-L-92, and 24-L-98N, all sold under the Genapol® tradename.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Further nonionic surfactants which may be included in the inventive compositions include alkoxylated alkanolamides, preferably $C_8$-$C_{24}$ alkyl di($C_2$-$C_3$ alkanol amides), as represented by the following formula:

$$R_5—CO—NH—R_6—OH$$

wherein $R_5$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R_6$ is a $C_1$-$C_4$ alkyl radical, preferably an ethyl radical.

According to certain particularly preferred embodiments the detersive surfactant constituent necessarily comprises a nonionic surfactant based on a linear primary alcohol ethoxylate particularly wherein the alkyl portion is a $C_8$ to $C_{16}$, but particularly a $C_9$ to $C_{11}$ alkyl group, and having an average of between about 6 to about 8 moles of ethoxylation.

One further useful class of nonionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO\text{-}(EO)_x(PO)_y(EO)_z\text{-}H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b\text{-}H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x\text{-}H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO\text{-}(EO)_x(BO)_n(EO)_y\text{-}H \quad (D)$$

wherein n is about 15, x is about 15 and y is about 15.

Still further useful nonionic block copolymer surfactants include ethoxylated derivatives of propoxylated ethylene diamine, which may be represented by the following formula:

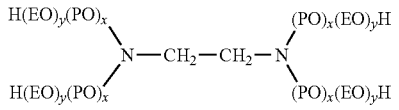

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful nonionic surfactants include nonionic amine oxide constituent. Exemplary amine oxides include:

A) Alkyl di (lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (hydroxy lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

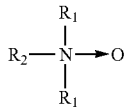

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group. Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Still further exemplary useful nonionic surfactants which may be used include certain alkanolamides including monoethanolamides and diethanolamides, particularly fatty monoalkanolamides and fatty dialkanolamides.

A cationic surfactant may be incorporated as a germicide or as a detersive surfactant in the solid block composition of the present invention, particularly wherein a bleach constituent is absent from the solid block composition. Cationic surfactants are per se, well known, and exemplary useful cationic surfactants may be one or more of those described for example in *McCutcheon's Functional Materials*, Vol. 2, 1998; *Kirk-Othmer, Encyclopedia of Chemical Technology*, 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

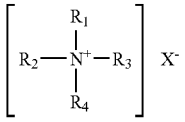

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are found useful in the practice of the present invention include those which have the structural formula:

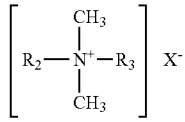

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in McCutcheon's as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTU) 50 NF (or BTC® 65 NF) is described to be alkyl dimethyl benzyl ammonium chloride (50% active); BTC® 99 is described as didecyl dimethyl ammonium chloride (50% active); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

Preferred quaternary germicides used in the compressed solid block compositions are those which are supplied in a solid or powdered form, as such greatly facilitates the manufacture of the compressed solid block compositions.

When present in a compressed solid block composition, it is preferred that the germicidal cationic surfactant(s) are present in amounts so to dispense at least about 200 parts per million (ppm) in the water flushed into the sanitary appliance, e.g., toilet bowl, or into the water retained in the sanitary appliance at the conclusion of the flush cycle.

Further detersive surfactants which may be included are amphoteric and zwitterionic surfactants which provide a detersive effect. Exemplary useful amphoteric surfactants include alkylbetaines, particularly those which may be represented by the following structural formula:

$$RN^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms.

As noted above, preferred detersive surfactants are those which exhibit a melting points above about 110° F., preferably above 125° F., in order to permit convenient processing according to known art techniques. Nonetheless small amounts of low melting point surfactants, i.e., those exhibiting melting points below about 110° F. and even liquid surfactants may be used in providing the surfactant constituent of the solid block composition.

As the performance requirements of the compressed solid blocks may differ according to their use as either in a ITB or in a ITC application, the amounts of the constituents present in a particular compressed solid block of the device may vary as well depending upon the final intended use of the treatment block.

When intended for use as in an ITB application or device, the detersive surfactant constituent may be present in any effective amount and generally comprises up to about 90% wt. of the total weight of a solid block composition, and the resultant treatment block formed therefrom. Preferably the detersive surfactant constituent comprises about 20-90% wt., more preferably 35-80% wt. of a compressed solid block composition, and when used as an ITB block the detersive surfactant constituent most preferably comprises about 50-75% wt. of a compressed solid block composition, and the resultant treatment block formed therefrom. When intended for use in an ITC application, the detersive surfactant constituent may be present in any effective amount and generally comprises up to about 60% wt. of the total weight of a compressed solid block composition, and the resultant treatment block formed therefrom. Preferably the detersive surfactant constituent comprises about 10-55% wt., more preferably 20-50% wt. of a compressed solid block composition, and the resultant treatment block formed therefrom.

In particularly preferred embodiments the compressed solid blocks of the invention necessarily comprise at least one surfactant, preferably at least one anionic surfactant.

Further exemplary chemical constituents may be one or more sanitizing agents or germicides which may be present with our without other constituents being present in the compressed solid blocks of the cageless lavatory dispensing devices.

The sanitizing agent can be any sanitizing composition known to those of ordinary skill in the relevant art, and without limitation exemplary sanitizing compositions include materials containing alkyl halohydantoins, alkali metal haloisocyanurates, bleach, essential oils, non-quaternary ammonium based germicidal compounds as well as quaternary ammonium germicidal compounds.

By way of non-limiting example, exemplary a bleach constituent. The bleach constituent is relatively inert in the dry state but, which on contact with water, releases oxygen, hypohalite or a halogen especially chlorine. Representative examples of typical oxygen-release bleaching agents, suitable for incorporation in the solid block composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N, N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro-imides, such as N-brominated and N-chlorinated succinimide, malonimide, phthalimide and naphthalimide. Also useful in the solid block composition as hypohalite-releasing bleaches are halohydantoins which may be used include those which may be represented by the general structure:

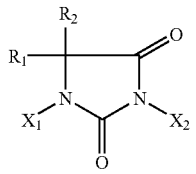

wherein:

$X_1$ and $X_2$ are independently hydrogen, chlorine or bromine; and, $R_1$ and $R_2$ are independently alkyl groups having from 1 to 6 carbon atoms. Examples of halohydantoins include, for example, N,N'-dichloro-dimethyl-hydantoin, N-bromo-N-chloro-dimethyl-hydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine dihydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the compressed solid treatment blocks formed therefrom.

When present, preferably the bleach constituent is a hypohalite liberating compound and more preferably is a hypohalite liberating compound in the form of a solid complex or hydrate thereof. Particularly preferred are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloropotassium dichloroisocynanurate complex. The most preferred chlorine bleach material is sodium dichloroisocyanurate; the dihydrate of this material being particularly preferred.

When present, the bleach constituent may be present in any effective amount and may comprise up to about 90% wt., preferably at least about 0.1-60% wt of the compressed solid block composition. More preferably, when present, the bleach constituent comprises about 0.5-50% wt., more preferably at least 1-40% wt. of the compressed solid block composition.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function; these have been described above with reference to detersive surfactants.

As a further chemical constituent, the compressed solid block compositions of the invention may also comprise a coloring agent which imparts either a color to the compressed solid blocks, to the water in which it comes into contact, but especially which imparts color to the water contained within the sanitary appliance. Where the sanitary appliance is a toilet, desirably the coloring agent imparts a color to the water contained within the cistern, or within the toilet bowl particularly following the flush cycle of a toilet, or may impart a color in both locations. Such coloring agents have great consumer appeal, and indeed any known art coloring agent may be provided in any effective amount in order to impart a coloring effect. Colorants, especially dyes, are preferred when formulated as dry powders to enable direct incorporation into compressed solid blocks of the invention, however, liquid colorants may be employed in conjunction with suitable carriers. Useful colorants include any materials which may provide a desired coloring effect. Exemplarly useful coloring agents include dyes, e.g., Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. When a bleach constituent is included in the compressed solid block composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions. Frequently however, a compressed solid block composition which includes a bleach constituent do not comprise any colorants. Desirably the colorants, when present, do not exceed 15% wt. of the compressed solid block composition, although generally lesser amounts are usually effective. When present, colorants are desirably present in an amount from about 0.1 to 15 percent of the total weight of the chemical composition.

The compressed solid block compositions may include a fragrance or other air treatment constituent. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

As noted above, in conjunction with or in the absence of a fragrance constituent, the compressed solid block compositions may comprise an air treatment constituent. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard.

As further chemical constituents, the compressed solid block compositions of the invention may comprise an anti-limescale agent, which can be generally classified as a cleaning agent in that it provides a cleaning effect to treated lavatory device surfaces. The anti-limescale agent can virtually any known anti-limescale agent compositions known to those of ordinary skill in the relevant art. For example, compositions containing anionic and/or nonionic surfactants together with typical anti-limescale agents, for example, amidosulfonic acid, bisulfate salts, organic acids, organic phosphoric salts, alkali metal polyphosphates, and the like. Examples of anti-limescale agent compositions can be found in, for example, U.S. Pat. Nos. 5,759,974; 4,460,490; and 4,578,207, the contents of which are herein incorporated by reference. Further examples of anti-limescale agents include organic acids (for example, citric acid, lactic acid, adipic acid, oxalic acid and the like), organic phosphoric salts, alkali metal polyphosphates, sulfonic, and sulfamic acids and their salts, bisulfate salts, EDTA, phosphonates, and the like.

The compressed solid block compositions may comprise stain inhibiting materials. The solid block composition of the invention may, for example, include an effective amount of a manganese stain inhibiting agent which is advantageously included wherein the sanitary appliance is supplied by a water source having an appreciable or high amount of manganese. Such water containing a high manganese content are known to frequently deposit unsightly stains on surfaces of sanitary appliances, especially when the solid block composition also contains a bleach source which provides a hypochlorite. To counteract such an effect the solid block composition of the present invention may comprise a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000. When present the satin inhibiting materials may comprise to about 10% wt. of the weight of the compressed solid block composition.

The compressed solid block compositions of the invention may include one or more preservatives. Such preservatives are primarily included to reduce the growth of undesired microorganisms within the treatment blocks formed from the solid block composition during storage prior to use or while used, although it is expected that the such a preservative may impart a beneficial antimicrobial effect to the water in the sanitary appliance to which the treatment block is provided. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.). When present, the optional preservative constituent should not exceed about 5% wt. of the solid block composition, although generally lesser amounts are usually effective.

The inventive compressed solid block compositions may include a binder constituent. The binder may function in part controlling the rate of dissolution of the tablet. The binder constituent may be a clay, but preferably is a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents. A wide variety of water-soluble organic polymers are suitable for use in the solid block composition of the present invention. Such polymers may be wholly synthetic or may be semi-synthetic organic polymers derived from natural materials. Thus, for example, on class of organic polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of organic polymers which may be used include naturally derived or manufactured (fermented) polymeric materials such as alginates and carageenan. Also, water-soluble starches and gelatin may be used as the optional binder constituent. The cellulose based binders are a preferred class of binders for use in the solid block composition and may possess the property of inverse solubility that is their solubility decreases with increasing temperature, thereby rendering the tablets of the invention suitable for use in locations having a relatively high ambient temperature.

The optional binder constituent may also be one or more synthetic polymers e.g, polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

In the case of the organic polymeric binders it may be noted that, in general, the higher the molecular weight of the polymer the greater the in-use life of the treatment block of the invention. When present, the total binder content may comprise up to 75% wt. of the solid block composition, but preferably is from 0.5 to 70% by weight, preferably from 1 to 65% by weight, more preferably from 5 to 60% by weight.

The solid block composition may optionally include one or more dissolution control agents. Such dissolution control agent are materials which provide a degree of hydrophobicity to the treatment block formed from the solid block composition whose presence in the treatment block contributes to the slow uniform dissolution of the treatment block when contacted with water, and simultaneously the controlled release of the active constituents of the solid block composition. Preferred for use as the dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. When included the dissolution control agent may be included in any effective amount, but desirably the dissolution control agent is present in an amount not to exceed about 600% wt. of the solid block composition, although generally lesser amounts are usually effective. Generally wherein the treatment block is to be used in an ITB application the dissolution control agent is present to about 12% wt., more preferably is present from 0.1-10% wt. and most preferably is present from about 3-8% wt. of the solid block compositions, as well as in the treatment blocks formed therefrom. Generally wherein the treatment block is to be used in an ITC application the dissolution control agent is present to about 50% wt., more preferably is present from 1-50% wt. and most preferably is present from about 10-40% wt. of the solid block compositions, as well as in the treatment blocks formed therefrom.

The compressed solid block compositions may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. When present, such water-softening agents or chelating agents should not exceed about 20% wt. of the solid block composition, although generally lesser amounts are usually effective.

The compressed solid block composition may optionally include one or more solid water-soluble acids or acid-release agents such as sulphamic acid, citric acid or sodium hydrogen sulphate. When present, such solid water-soluble acids or acid-release agents should not exceed about 20% wt. of the solid block composition, although generally lesser amounts are usually effective.

The compressed solid block compositions may include diluent materials may be included to provide additional bulk of the product solid block composition and may enhance leaching out of the surfactant constituent when the solid block composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein. Exemplary organic diluents include, inter alia, urea, as well as water soluble high molecular weight polyethylene glycol and polypropylene glycol. When present, such diluent materials should not exceed about 80% wt. of the compressed solid block composition, although generally lesser amounts are usually effective.

The compressed solid block composition and treatment blocks formed therefrom may include one or more fillers. Such fillers are typically particulate solid water-insoluble materials which may be based on inorganic materials such as talc or silica, particulate organic polymeric materials such as finely comminuted water insoluble synthetic polymers. When present, such fillers should not exceed about 30% wt. of the compressed solid block composition, although generally lesser amounts are usually effective.

Preferably the compressed solid block of the invention includes silica. Silica has been observed to aid in the controlling the rate of dissolution of the compressed solid blocks of the invention.

The compressed solid block composition and treatment blocks formed therefrom may include one or more further processing aids. For example, the solid block composition may also include other binding and/or plasticizing ingredients serving to assist in the manufacture thereof, for example, polypropylene glycol having a molecular weight from about 300 to about 10,000 in an amount up to about 20% by weight, preferably about 4% to about 15% by weight of the mixture may be used. The polypropylene glycol reduces the melt viscosity, acts as a demolding agent and also acts to plasticize the block when the composition is prepared by a casting process. Other suitable plasticizers such as pine oil fractions, d-limonene, dipentene and the ethylene oxide-propylene oxide block copolymers may be utilized. Other useful processing aids include tabletting lubricants such as metallic stearates, stearic acid, paraffin oils or waxes or sodium borate which facilitate in the formation of the treatment blocks in a tabletting press or die.

One advantageously utilized processing aid is a diester constituent which may be represented by the following structure:

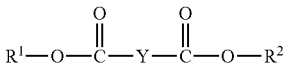

wherein:

$R^1$ and $R^2$ can independently be $C_1$-$C_6$ alkyl which may optionally substituted, Y is $(CH_2)_x$, wherein x is 0-10, but is preferably 1-8, and while Y may be a linear alkyl or phenyl moiety, desirably Y includes one or more oxygen atoms and/or is a branched moiety.

Exemplary diester constituents include the following diester compounds according to the foregoing structure: dimethyl oxalate, diethyl oxalate, diethyl oxalate, dipropyl oxalate, dibutyl oxalate, diisobutyl oxalate, dimethyl succinate, diethyl succinate, diethylhexyl succinate, dimethyl glutarate, diisostearyl glutarate, dimethyl adipate, diethyl adipate, diisopropyl adipate, dipropyl adipate, dibutyl adipate, diisobutyl adipate, dihexyladipate, di-$C_{12-15}$-alkyl adipate, dicapryl adipate, dicetyl adipate, diisodecyl adipate, diisocetyl adipate, diisononyl adipate, diheptylundecyl adipate, ditridecyl adipate, diisostearyl adipate, diethyl sebacate, diisopropyl sebacate, dibutyl sebacate, diethylhexylsebacate, diisocetyl dodecanedioate, dimethyl brassylate, dimethyl phthalate, diethyl phthalate, dibutyl phthalate.

Preferred diester constituents include those wherein Y is —$(CH_2)_x$— wherein x has a value of from 0-6, preferably a value of 0-5, more preferably a value of from 1-4, while $R^1$ and $R^2$ are $C_1$-$C_6$ alkyl groups which may be straight chained alkyl but preferably are branched, e.g, iso- and tert-moieties. Particularly preferred diester compounds are those in which the compounds terminate in ester groups.

A further advantageously utilized processing aid is a hydrocarbon solvent constituent. The hydrocarbon solvents are immiscible in water, may be linear or branched, saturated or unsaturated hydrocarbons having from about 6 to about 24 carbon atoms, preferably comprising from about 12 to about 16 carbon atoms. Saturated hydrocarbons are preferred, as are branched hydrocarbons. Such hydrocarbon solvents are typically available as technical grade mixtures of two or more specific solvent compounds, and are often petroleum distillates. Nonlimiting examples of some suitable linear hydrocarbons include decane, dodecane, decene, tridecene, and combinations thereof. Mineral oil is one particularly preferred form of a useful hydrocarbon solvent. Further preferred hydrocarbon solvents include paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

When present such further processing aids are typically included in amounts of up to about 30% by weight, preferably to 20% wt. of the solid block composition, although generally lesser amounts are usually effective.

Optionally but in some cases, preferably one or more of the foregoing constituents may be provided as an encapsulated, particularly a microencapsulated material. That is to say, quantities of one or more constituents are provided covered or encapsulated in an encapsulating material. Methods suitable for such an encapsulation include the customary methods and also the encapsulation of the granules by a melt consisting e.g. of a water-soluble wax, coacervation, complex coacervation and surface polymerization. Non-limiting examples of useful encapsulating materials include e.g. water-soluble, water-dispersible or water-emulsifiable polymers and waxes. Advantageously, reactive chemical constituents, particularly the fragrance composition when present, may be provided in an encapsulated form so to ensure that they do not prematurely degrade during processing of the constituents used to form the compressed solid block composition and that they are retained with minimal degradation in the compressed solid block composition prior to their use. The use of water soluble encapsulating material is preferred as such will release the one or more chemical constituents when the compressed solid block composition is contacted with water supplied either in the cistern or in the toilet bowl.

Ideally the compressed solid blocks exhibit a density greater than that of water which ensures that they will sink when suspended in a body of water, e.g., the water present within a cistern. Preferably the treatment blocks formed from the solid block composition exhibit a density in excess of about 1 g/cc of water, preferably a density in excess of about 1.5 g/cc of water and most preferably a density of at least about 2 g/cc of water.

While the mass of the compressed solid blocks may vary, and amount of up to an including 500 grams may be practiced, generally the mass of the compressed solid block compositions do not exceed about 150 grams. Advantageously the mass of the compressed solid blocks is between about 20 and 100 grams. It is appreciated that compressed solid blocks having great mass should provide a longer useful service life of the cageless lavatory dispensing devices, with the converse being equally true.

The compressed solid blocks according to the present invention may also be provided with a coating of a water-soluble film, such as polyvinyl acetate following the formation of the treatment blocks from the recited solid block composition. Such may be desired for improved handling, however such is often unnecessary as preferred embodiments of the compressed blocks exhibit a lower likelihood of sticking to one another following manufacture than many prior art treatment block compositions.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

The compressed solid blocks may be formed of a single chemical composition, or may formed of two (or more) different chemical compositions which may be provided as separate regions of a solid block, such as a first layer of a solid block consisting of a first chemical composition, alongside a second layer of a the solid block consisting of a second chemical composition which is different than the first chemical composition. The block may also be formed of two or more separate blocks which are simply layered or otherwise assembled, without or without the use of an adhesive. Further layers of still further different chemical compositions may also be present. Such solid blocks formed having two or more discrete layers or regions of, respectively, two or more different chemical compositions may be referred to as composite blocks.

Any form of the compressed solid blocks may also be provided with a coating film or coating layer, such as a water soluble film which is used to overwrap the chemical composition provided in the device which film provides a vapor barrier when dry, but which dissolves when contacted with water. Alternately the compressed solid blocks may be oversprayed or dipped into a bath of a water soluble film forming constituent, and thereafter removed and thus allowing the water soluble film forming constituent to dry and form a coating layer on the compressed solid block.

Exemplary materials which may be used to provide such a coating on some or all of the surfaces of the compressed solid block compositions include one or more of the following: Rhodasurf TB-970 described by its supplier to be a tridecyl alcohol having a degree of ethoxylation of approximately 100 having an HLB of 19, and exhibiting a melting point in the range of 52-55° C.; Antarox F-108 which is described to be an EO-PO block copolymer having a degree of ethoxylation of approximately 80% and having a melting point in the range of 54-60° C.; further materials including those identified as Pluriol Z8000, and Pluriol E8000 which are believed to be optionally substituted, high molecular weight polyethylene glycols ("PEG") having a sufficiently high molecular weight such that they have a melting point of at least 25° C., preferably a melting point of at least about 30° C. may also be used. Other water soluble materials, desirably those which have a melting point in the range of about 30-70° C., and which may be used to provide a water soluble or water dispersible coating on the compressed solid blocks are also contemplated to be useful, especially synthetic or naturally occurring waxy materials, and high molecular weight polyalkylene glycols, especially polyethylene glycols. Certain of these coating materials may be surfactants. Generally such materials may be provided as a dispersion in water, an organic solvent or in an aqueous/organic solvent, but preferably are used as supplied from their respective supplier and are heated to at least their melting points in order to form a liquid bath. Conveniently, the compressed solid blocks affixed to the plate of a hanger are then conveniently dipped into the said bath, thereby providing a coating layer to the compressed solid blocks. Alternately, the coating materials may be sprayed, brushed on or padded onto at least part of the surfaces of the previously formed compressed solid blocks.

The application of a water soluble film or coating is preferred in certain embodiments of the invention as the surface film may facilitate the handling of the blocks during packaging and storage prior to use of the cageless lavatory dispensing devices. Further, the application of a water soluble film or coating is preferred as certain water soluble film former compositions may impart a desirable surface gloss to the compressed lavatory blocks.

Preferably the compressed solid block compositions useful in the cageless lavatory dispensing devices include those which comprise at least one surfactant, preferably at least one anionic or nonionic surfactant.

Exemplary compositions which can be used to form the compressed solid blocks of the present invention are shown in the following table below; the amounts indicates are in % wt. of the "as supplied" constituent used to form an example block compositions, labeled A through F.

| Component | A | B | C | E | F |
|---|---|---|---|---|---|
| dodecyl Benzene Sulfonate Na[1] | 25 | 10 | 40 | 35 | 35 |
| Alfa Olefin Sulfonate Na[2] | 25 | 10 | 5 | 32 | 32 |
| lauryl monoethanolamide[3] | 10 | 8 | 5 | 2 | 5 |
| sodium Lauryl Ether Sulfate[4] | 10 | — | — | 4.5 | 5 |
| Pluronic 68[5] | 10 | — | — | 3 | — |
| Na Sulfate | 20 | — | — | 21.5 | 21 |
| Pluronic 87 or 88[6] | — | 70 | 50 | — | — |

-continued

| Component | A | B | C | E | F |
|---|---|---|---|---|---|
| alcohol ethoxylate $C_9$-$C_{11}$ 6EO[7] | — | 2 | — | — | — |
| silica | — | — | — | 2 | 2 |

[1]Dodecyl Benzene Sulfonate Sodium (80-90% active) -- anionic
[2]Alpha Olefin Sulfonate Sodium -- anionic
[3]Lauryl Monoethanolamide -- non-ionic
[4]Sodium Lauryl Ether Sulfate (70% active) -- anionic
[5]Polyoxyethylene (160) polyoxypropylene (30) glycol - non-ionic
[6]Pluronic 87 $E_{61}$ $P_{41.5}$ $E_{61}$ -- Molecular Weight 7700 -- HLB 24 -- non-ionic
Pluronic 88 $E_{98}$ $P_{41.5}$ $E_{98}$ -- Molecular Weight 10800 -- HLB 28-- non-ionic
[7]Alcohol ethoxylate $C_9$-$C_{11}$ 6EO -- non-ionic Further exemplary bleach containing compositions which can be used to form the compressed solid blocks of the present invention include compositions indicated on the next table having the general ranges as follows:

| | % w/% w |
|---|---|
| alpha olefin sulfonate | 0-35 |
| sodium lauryl ether sulfate | 3.0-6.0 |
| bleaching agent (e.g., DCCNa or Hydantoin) | 0.5-25 |
| lauryl monoethanolamide | 2.0-5.0 |
| dodecyl benzene sulfonate Na | 50-70 |
| Na sulfate anhydrous | 15-25 |
| silica | 1.0-2.0 |

Further exemplary preferred embodiments of blocks which are useful as compressed solid blocks of the present invention include those which comprise:

10-35% wt., preferably 15-30% wt. of an alpha olefin sulfonate anionic surfactant;

10-35% wt., preferably 15-30% wt. of a linear monoethanolamide;

5-50% wt., preferably 15-35% wt. of a linear dodecylbenzene sulfonate anionic surfactant;

5-50% wt., preferably 20-35% wt. of sodium sulfate 0.1-15% wt., preferably 0.5-5% wt. of silica 0.1-25% wt., preferably 1-10% wt. sodium lauryl ether sulfate optionally to 40% wt. further additive constituents, including but not limited to further surfactants, fillers, binders, fragrances, processing aids such as lubricants and tabletting aids, bleaches, sanitizing compositions and the like.

Yet further exemplary compositions which include a bleach constituent which find use as compressed solid blocks of the present invention include those recited on the following tables, and labeled as G through N:

| | G | H | I | J | K |
|---|---|---|---|---|---|
| dodecylbenzene sulfonate, sodium salt (80%) | 27.0 | 22.0 | 32.0 | 35.00 | 37.8 |
| sodium C14/C16 olefin sulfonates (80%) | 15.0 | 20.0 | 15.0 | 22.0 | 23.62 |
| silica | 2.0 | 2.0 | 2.0 | 2.0 | 1.89 |
| lauramide monoethanol amide (98%) | 30.0 | 30.0 | 25.0 | 15.00 | 12.28 |
| sodium sulfate | 20.5 | 20.5 | 20.5 | 20.50 | 18.90 |
| dichlorocyanurate dihydrate, sodium salt (56% bleach) | 2.5 | 2.5 | 2.5 | 2.4 | 2.41 |
| paraffinic hydrocarbons | 3.0 | 3.0 | 3.0 | 3.1 | 3.09 |

| | L | M | N | O |
|---|---|---|---|---|
| dodecylbenzene sulfonate, sodium salt (80%) | 32.0 | 35.0 | 37.0 | 32.0 |
| sodium C14/C16 olefin sulfonates (80%) | 20.0 | 22.0 | 25.0 | 20.0 |
| silica | 2.0 | 2.0 | 2.0 | 2.0 |
| lauramide monoethanol amide (98%) | 20.0 | 15.0 | 10.0 | 20.0 |
| sodium sulfate | 20.5 | 20.5 | 20.5 | 18.5 |
| dichlorocyanurate dihydrate, sodium salt (56% bleach) | 2.5 | 2.5 | 2.5 | 2.5 |
| paraffinic hydrocarbons | 3.0 | 3 | 3 | 5 |

The identity of the constituents used to form the foregoing compressed solid blocks G-O are identified more specifically on the following table.

| | |
|---|---|
| dodecylbenzene sulfonate, sodium salt (80%) | anionic surfactant, dodecylbenzene sulfonate, 80% wt. actives |
| sodium C14/C16 olefin sulfonates (80%) | anionic surfactant, sodium C14/C16 olefin sulfonates, 80% wt. actives |
| silica | filler anhydrous silica, 100% wt. actives. |
| lauramide monoethanol amide (98%) | solubility control agent, lauramide monoethanol amide, 98% wt. actives |
| sodium sulfate | diluent, sodium sulfate, 100% wt. actives |
| dichlorocyanurate dihydrate, sodium salt (56%) | bleach constituent, dichlorocyanurate dihydrate, sodium salt, 56% wt. bleach actives |
| Isopar M | hydrocarbon solvent, isoparaffinic organic solvents, 100% wt. actives |
| mineral oil | Hydrocarbon solvent, mineral oil, 100% wt. actives |
| paraffinic hydrocarbons | Hydrocarbon solvent, white paraffin oil, 100% wt. actives |

Still further exemplary compositions which include diisopropyl adipates which find use as compressed solid blocks of the present invention include those recited on the following tables, and labeled as P through W:

| | P | Q | R | S |
|---|---|---|---|---|
| dodecylbenzene sulfonate, sodium salt (80%) | 55.85 | 58.85 | 62.51 | 62.51 |
| silica | 2.41 | 2.41 | 2.56 | 2.56 |
| lauramide monoethanolamide (98%) | 6.01 | 6.01 | 6.38 | 6.38 |
| sodium sulfate | 12 | 12 | 12.75 | 12.75 |
| dichlorocyanurate dihydrate, sodium salt (56%) | 14.63 | 14.63 | 9.32 | 9.32 |
| diisopropyl adipate | 6.1 | 6.1 | 6.48 | 6.48 |

| | T | U | V | W |
|---|---|---|---|---|
| dodecylbenzene sulfonate, sodium salt (80%) | 58.61 | 67.27 | 69.25 | 70.83 |
| silica | 2.40 | 1.91 | 1.96 | 2.01 |
| lauramide monoethanolamide (98%) | 5.98 | 4.74 | 4.88 | 4.99 |
| sodium sulfate | 11.95 | 17.37 | 17.88 | 18.29 |
| dichlorocyanurate dihydrate, sodium salt (56%) | 14.6 | 4.98 | 2.41 | 0.55 |
| diisopropyl adipate | 6.46 | 3.73 | 3.61 | 3.33 |

The identity of the constituents used to form the foregoing compressed solid blocks labeled P through W are identified more specifically on the following table:

| | |
|---|---|
| dodecylbenzene sulfonate, sodium salt (80%) | anionic surfactant, dodecylbenzene sulfonate, 80% wt. actives |
| silica | anhydrous silica, 100% wt. actives. |
| lauramide monoethanolamide (98%) | solubility control agent, lauramide monoethanolamide, 98% wt. actives |

-continued

| | |
|---|---|
| sodium sulfate | diluent, sodium sulfate, 100% wt. actives |
| dichlorocyanurate dihydrate, sodium salt (56%) | bleach constituent, dichlorocyanurate dihydrate, sodium salt, 56% wt. bleach actives |
| diisopropyl adipate | diester constituent, diisopropyl adipate, 100% wt. actives |

Yet further exemplary compositions which include paraffinic hydrocarbon solvents or mineral oil which find use as compressed solid blocks of the present invention include those recited on the following tables, and labeled as AA through AK:

| | AA | AB | AC | AD | AE | AF |
|---|---|---|---|---|---|---|
| dodecylbenzene sulfonate, sodium salt (80%) | 65.8 | 65.8 | 65 | 64.17 | 69.25 | 70.83 |
| silica | 2.69 | 2.69 | 2.66 | 2.63 | 1.96 | 2.01 |
| lauramide monoethanolamine (98%) | 6.72 | 6.72 | 6.64 | 6.55 | 4.88 | 4.99 |
| sodium sulfate | 13.42 | 13.42 | 13.26 | 13.09 | 17.88 | 18.29 |
| dichlorocyanurate dihydrate, sodium salt (56% bleach) | 8.89 | 8.89 | 8.78 | 9.57 | 2.41 | 0.55 |
| Isopar M | 2.47 | 2.47 | — | — | — | 3.33 |
| mineral oil | — | — | 3.66 | 3.99 | 3.61 | — |

| | AG | AH | AI | AJ | AK |
|---|---|---|---|---|---|
| dodecylbenzene sulfonate, sodium salt (80%) | 69.25 | 69.25 | 69.25 | 70.83 | 68.31 |
| silica | 1.96 | 1.96 | 1.96 | 2.01 | 2.90 |
| lauramide monoethanolamine (98%) | 4.88 | 4.88 | 4.88 | 4.99 | 4.88 |
| sodium sulfate | 17.88 | 17.88 | 17.88 | 18.29 | 17.88 |
| dichlorocyanurate dihydrate, sodium salt (56% bleach) | 2.41 | 2.41 | 2.41 | 0.55 | 2.41 |
| Isopar M | 3.61 | 3.61 | — | — | 3.61 |
| mineral oil | — | — | 3.61 | 3.33 | — |

The identity of the constituents used to form the foregoing blocks AA through AK are identified more specifically on the following table:

| | |
|---|---|
| dodecylbenzene sulfonate, sodium salt (80%) | anionic surfactant, dodecylbenzene sulfonate, 80% wt. actives |
| silica | filler anhydrous silica, 100% wt. actives. |
| lauramide monoethanolamide (98%) | solubility control agent, lauramide monoethanolamide, 98% wt. actives |
| sodium sulfate | diluent, sodium sulfate, 100% wt. actives |
| dichlorocyanurate dihydrate, sodium salt (56%) | bleach constituent, dichlorocyanurate dihydrate, sodium salt, 56% wt. bleach actives |
| Isopar M | hydrocarbon solvent, isoparaffinic organic solvents, 100% wt. actives |
| mineral oil | Hydrocarbon solvent, mineral oil, 100% wt. actives |

Yet further and particularly preferred embodiments of compressed solid blocks and their compositions include those which are recited on Table 1.

The manufacture of the cageless lavatory dispensing device first contemplates mixing the constituents of the block composition into a generally homogenous mass such as by noodling, as well as by plodding, but preferably by extruding, and thereafter forming a "preform" from a measured quantity of the homogenous mass. Usually all of the solid ingredients are mixed in any suitable blending equipment followed by the addition of liquid ingredients under blending conditions. In an extrusion process a mixture of the chemical constituents used to ultimately form the compressed solid block composition is made, followed by extrusion of this mixture into a rod or bar form which is then cut into appropriately sized pieces or blocks which are to be used in the subsequent, separate compression process. These pieces or blocks of extrudate are the preforms. When a compressed solid block is formed from a single perform it is required to provide a cavity, channel or recess within the preform of suitable dimensions to accept a part of the hanger, advantageously a plate. Conveniently a channel may be provided by cutting a slot in the preform of sufficient depth and width such that the plate may be fully inserted into the interior of the preform prior to the subsequent compression process. The channel may be cut, or carved such as by the use of a saw, or other cutting device which will either split or shape the preform adequately to provide such a suitable sized channel or recess. Alternately a channel may be providing by extruding through a die which includes a blade or other cutter means which extends into the open cross-section of the die such that as the extrudate exits the die, it is provided with such a channel which partially splits the extrudate into the legs of a "V", which remain attached however at the base of each leg. Such a channel may extend across the length of the preform and through the ends thereof. Alternately, subsequent to extrusion a tool such as a plunging blade may be used to partially split a portion of a preform in order to provide a cavity or slot which is of sufficient width and depth to accommodate at least the plate of the hanger. Such a cavity formed by such blade typically does not extend across the length of the preform nor through the ends thereof.

While the foregoing process steps outlined relate to a device which includes a plurality of compressed solid block compositions which are formed from the same chemical composition to form a plurality of pieces or blocks which are to be used in the subsequent, separate compression process, wherein the device of the invention utilizes two or more different compressed solid block compositions, then the foregoing process steps may be repeated for any second or further compressed solid block compositions in order to form pieces or blocks formed from said second or further compressed solid block compositions which are to be used in the subsequent, separate compression process In a next process step, a part of the device of the invention, such as the hanger or support structure is inserted within the interior of the channel or cavity of one or more preforms such that a part of said device is preferably wholly encased within the interior of the preform. Afterwards preform enclosing part of the hanger or support structure is then compressed in a die which imparts the final shape to the compressed solid block. This compression step may be practiced as a single compression operation or as a series of compression steps, i.e., with two or more stamping or compression operations. Advantageously the preform(s) are positioned in a die such that the hanger or support structure is parallel to the opposing major faces of the compression dies which are brought together. Optionally a mold release agent, such as a waxy material or an oil, such as a paraffin oil or mineral oil may be applied to one or more surfaces of the die. Such may improve the ease of release of the compressed solid blocks, and/or aid in the formation of a smooth external surface to the compressed solid blocks encasing a part of the hanger or support structure. Following compression the compressed solid block may be removed from or ejected from the die.

As noted previously a preform used to form the compressed solid blocks may be formed from a plurality of preforms which are conveniently layered in register, with the hanger inserted between two preforms in the orientation as described above. For example, two or more physically separate preforms may be layered in register to form a laminated compressed solid block. Such may be desired when it is intended that the compressed solid block be formed from two or more masses having different chemical compositions. For example, it is contemplated that a compressed solid mass may be formed from a first preform having a first chemical composition, compressed to a second preform having a second chemical composition which is different than the first chemical composition. By way of non-limiting example, the first preform may be of a first color, while the second preform may be of different, second color so that when compressed the preforms are compressed to form a single compressed solid block having two different colored layers. Of course, three or more preforms may be compressed to form a single compressed block. Again the chemical compositions of the first, second and third preforms may be of the same, similar or of different compositions.

During the compression step, several simultaneous technical effects occur. The block compositions are densified due to the compression, and concurrently the embedded hanger or support structure is sealed and mechanically anchored within the interior of a block. Preferably the density of the compressed solid block as at least 1% greater, preferably at least 1.5% greater than the density of the density of the extrudate. Preferably the density of the compressed solid block is at least 2%, more preferably at least 3% greater than the density of the preform or extrudate from which it is formed. Additionally during the compression step, the channel, slot or recess which had been formed to accept the hanger or support structure is sealed to form a smooth surface. Still further the exterior surface of the block composition takes on the volume configuration and the surface shape of the die. Such is particularly advantageous when the interior surface of the die is smooth walled which will, in preferred embodiments, impart a smooth exterior surface to the compressed solid block.

The devices according to the invention comprise a plurality of compressed solid treatment blocks, which may be two or more treatment blocks. While the geometry and/or configuration and/or masses of the individual compressed solid treatment blocks may be the same, such is not required and devices having compressed solid treatment blocks having at least two different geometries and/or configurations and/or masses may be present in a device according to the invention. In certain particularly preferred embodiments each of the plurality of compressed solid blocks of the present invention weigh from 5 to 150 grams, preferably from about 5 to about 75 grams.

The devices of the invention may be provided fully assembled and configured for use by a consumer or may require reconfiguration from their packaged configuration. For example the devices of the invention may be packaged in fully assembled state but which may require a consumer to reconfigure, e.g., fold or bend one or more elements into a further configuration. Coming into consideration are where the hook is required to be extended, as well as wherein one or more support structure may require to be unfolded into a final form suited for installation into a lavatory appliance. The devices may be packaged such that they might require final assembly after being removed from the package in which they were provided, such as wherein one or more support structure would need to be affixed to the hook, stalk or hanger prior to installation into a lavatory appliance.

In preferred embodiments the service life of the compressed solid blocks of the devices of the invention should be from about 5 to about 30 days, based on 6 flushes per day. Preferably the service life of the compressed solid blocks is measured when the devices of the invention are installed on the rim of a toilet bowl such that the said block is positioned adjacent to the sloping interior sidewall of the toilet bowl and is subjected to between 6-12 flushes per day. Preferably the temperature of the water which is flushed is in the range of 16-24° C. The length of life of the plurality of compressed solid blocks will of course depend on a variety of factors including their individual formulation, their relative position to the sidewall of the lavatory appliance, their geometries, the water temperature, tank size, the number of flushes over the period of use and the volume of the water which contacts the compressed solid blocks.

Various configurations of the cageless lavatory dispensing device, including certain particularly preferred embodiments, are depicted on the following figures. In the accompanying figures, like elements are indicated using like numerals throughout the figures.

FIG. 1 illustrates in a perspective view a first embodiment of a dispensing device 10 according to the invention which includes a hanger 20 having depending thereform two support structures 30*a*, 30*b*, each individual support structure bearing a single compressed solid block 40*a*, 40*b*. In cross-section, these support structures 30*a*, 30*b* are generally rectangular in configuration, and these support structures 30*a*, 30*b* overall are long, thin plates. As is visible from the figures, most of each of the two support structures 30*a*, 30*b* are embedded in the respective compressed solid block 40*a*, 40*b*. The hanger 20 includes at its distal end 21 end a hook 22 which is an articulated element to which includes a first section 22*a*, and a second section 22*b* which extends to and connects with the stalk 24 of the hanger 20. Providing these articulated elements allows for the flexible extension of the hook 22 in order that it may be configured so that the device 10 can be suspended from part of a lavatory appliance, particularly from the rim of a toilet bowl. At the distal end 25 of the hanger 20 is it depicted a connector 26, here in the form of a generally block-shaped element which can be affixed to respective exposed ends 32*a*, 32*b* of the two support structures 30*a*, 30*b*. Such an interconnection between these elements can be permanent, or can be removable such that the compressed solid blocks 40*a*, 40*b* borne by their respective support structures 30*a*, 30*b* can be affixed, but later replaced on the connector 26. Such may be desired, for example wherein the device 10 is provided in a package in which the individual elements forming the device 10 are in an unassembled form. For example, the package may include the hanger 20 as an element separate from the compressed solid blocks 40*a*, 40*b* borne by their respective support structures 30*a*, 30*b*. In such a configuration, the consumer can very conveniently simply affix, such as by snapping into place in the exposed ends 32*a*, 32*b* of the two support structures 30*a*, 30*b* into corresponding recesses or parts of the connector 26 in order to assemble the device 10. As is further clearly visible from the figure, the compressed solid blocks 40*a*, 40*b* borne by their respective support structures 30*a*, 30*b* when affixed to the connector 26 in order to form the complete device 10 directs the compressed solid blocks 40*a*, 40*b* in a generally co-linear direction which is however perpendicular to the axis of the stalk 24 of the hanger 20. Such an assembled the geometry is particularly convenient as such readily permits for the installation of the device 10 wherein the hook 22 can be extended to grass part of a toilet bowl, and simultaneously the compressed solid blocks 40*a*, 40*b* borne by their respective support structures 30*a*, 30*b* can be positioned beneath the rim of a toilet bowl such that the compressed solid blocks 40*a*, 40*b* are in the path of flush water emanating from beneath the toilet bowl rim. In such a manner, with each flush, a treatment composition can be formed by the water exiting from the rim of the toilet bowl, and thereafter coming into contact with the compressed solid blocks 40*a*, 40*b* and dissolving or deluding part of the same to form a treatment composition therefrom which can be used to treat further parts of the toilet bowl and particularly the interior surfaces of the toilet bowl.

Figure 2:
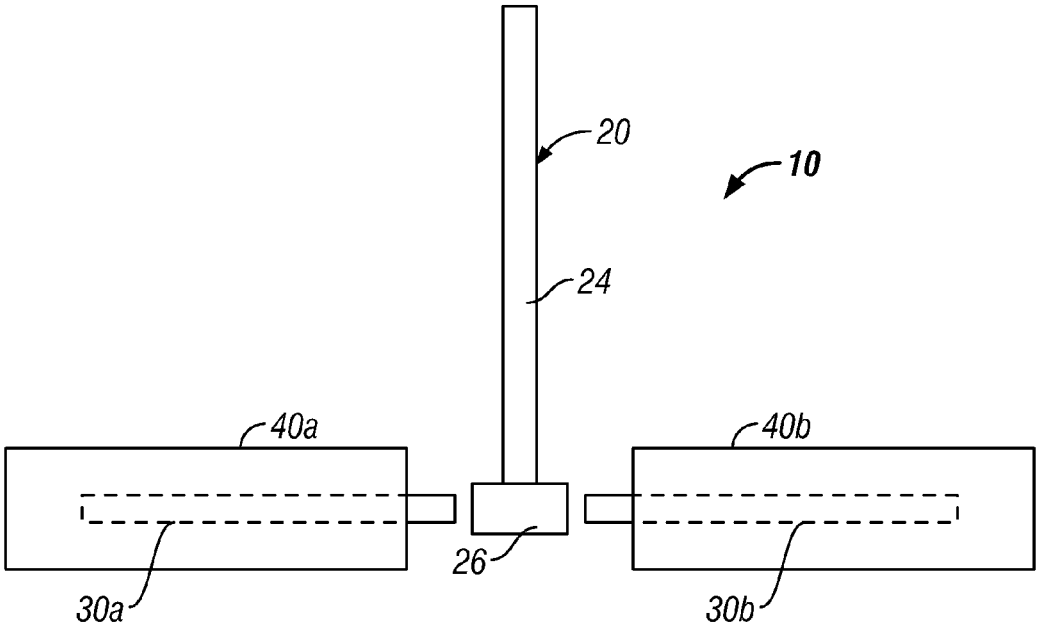

FIG. 2 illustrates in a plan view the dispensing device 10 previously discussed with reference to FIG. 1. In the current figure, the separation of the device 10 into three separate elements is shown illustrating this particular embodiment of the dispensing device 10 in an unassembled form as might be provided as a vendible article in a suitable package. When provided in such a form, the consumer can conveniently and readily assembled a device in the manner described above, and thereafter install the device has also described above.

Figure 3:
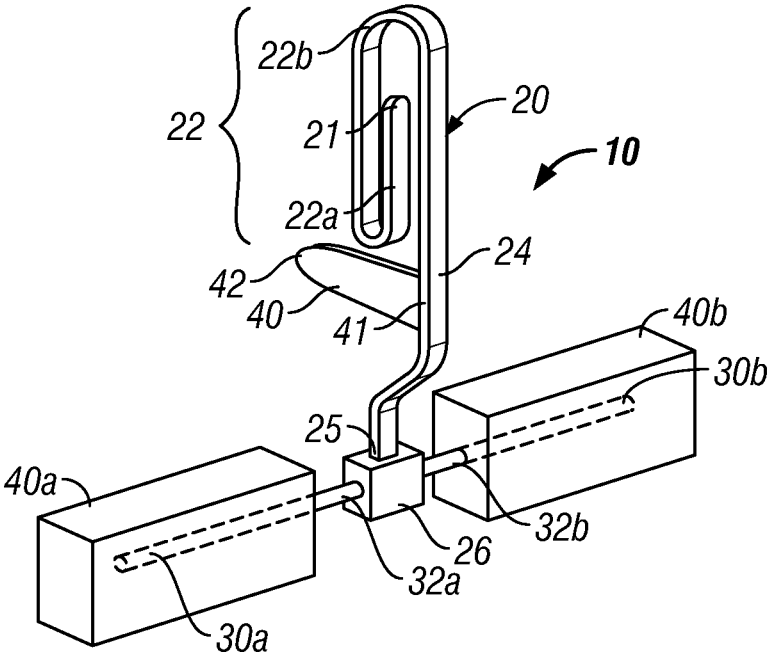

FIG. 3 illustrates in a perspective view a further embodiment of a dispensing device 10 according to the invention which is substantially the same as the embodiment of the device disclosed in FIG. 1 but wherein the support structures 30*a*, 30*b* are generally circular in cross-section such that the support structures 30*a*, 30*b* are generally rods, and additionally the hanger 20 includes a rearwardly directed standoff element 40 which extends from a portion of the stalk 24 and is directed rearwardly, that is the say in the direction of the folded hook 22. In such a manner, when the device 10 is installed and is intended within the interior of a toilet bowl, the peak 42 of the standoff element 40 is configured such that it comes into contact with the interior sidewall of a portion of a lavatory appliance, and especially with the sidewall of a toilet bowl at a point below the rim of the toilet bowl. The base 41 of the standoff element 40 is conveniently and advantageously integrally formed as part of the hanger 20 and conveniently extends from a portion of the stalk 24 at a point intermediate the hook 22 and the distal end 25 of the hanger 20. Again, as is visible from this figure, the compressed solid blocks 40*a*, 40*b* borne by their respective support structures 30*a*, 30*b* are affixed to a connector 26 and extend generally linearly with respect to one another, and simultaneously are also a generally perpendicular to the stalk 24 of the hanger 20.

Figure 4:
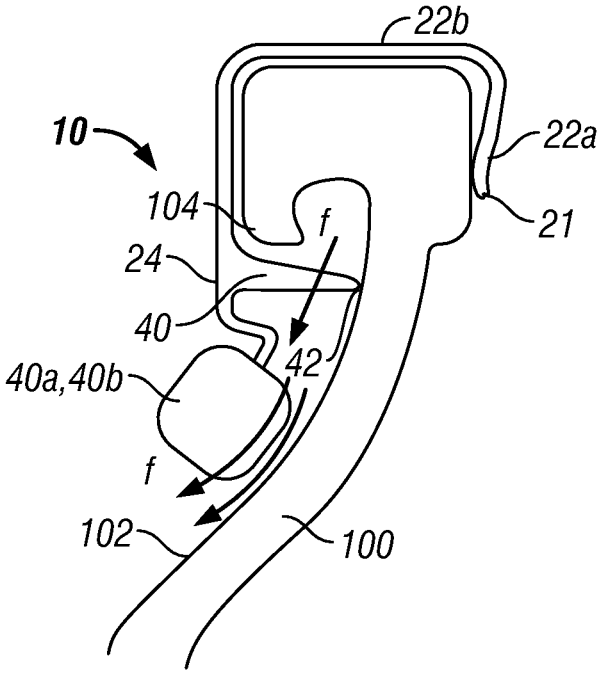

FIG. 4 illustrates in a cross-sectional view the device 10 as discussed with reference to the embodiment of FIG. 3 mounted on the interior of a toilet bowl 100. As is shown, the first section 22*a*, and a second section 22*b* of the hook 22 are extended such that they grasp a portion of the toilet bowl rim at 104 and simultaneously positions the compressed solid blocks 40*a*, 40*b* in the path of flowing flush water as illustrated by arrows labeled "f" such that the flowing flush water f comes into contact with the compressed solid blocks 40*a*, 40*b* and thereby permits for the formation of a treatment composition. The device 10 also includes a standoff element 40 which is rearwardly directed, and whose peak 42 comes into contact with the inner sidewall 102 of a toilet bowl 100. As shown, the geometry of the hanger 20 and the standoff element 40 ensures that the compressed solid blocks 40*a*, 40*b* are positioned within the path of flush water but are spaced apart from the inner sidewall 102 of the toilet bowl 100. Such positioning ensures that between flushes, the compressed solid blocks 40*a*, 40*b* may have the opportunity to lease partially, or to wholly dry which may have a beneficial effect in extending the service life of the device 10.

Figure 5:
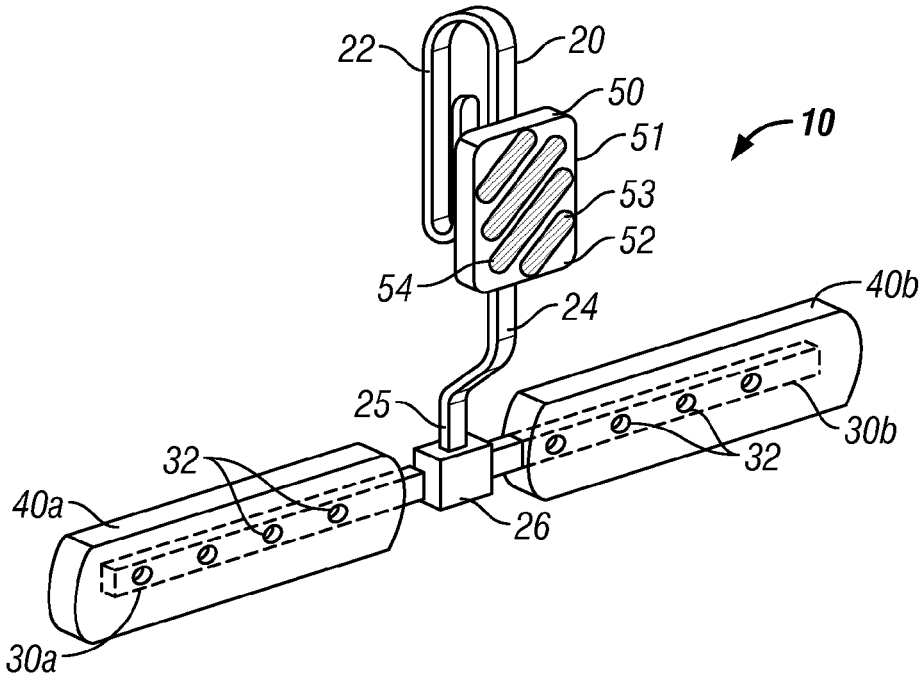

FIG. 5 depicts a still further embodiment of a dispensing device 10 according to the invention which includes a hanger 20 which includes a hook 22, a proximal end 25 attached to a connector 26, and a stalk 24 intermediates the hook 22 and the proximal end 25. The stalk 24 has mounted thereon and air treatment dispenser 50 which in the particular embodiment illustrated it takes the form of a housing 51 having a front face 52 through which extend a plurality of slots 53 exposing an air treatment material 54 to the ambient environments via these slots 53. In the embodiment depicted, the air treatment material 54 is in the form of a pad or wick which includes a quantity of a fragrance or perfume composition which when exposed to the ambient environment of the dispensing device 10, may volatilize and pass from the interior of the housing 51 via these slots 53 into the ambient environment. Of course, any other air treatment composition may be dispensed in a similar manner. Additionally, it is to be understood that any other air treatment material or air treatment composition having a different form than illustrated in the current figure may also be utilized and provided as part of the dispensing device 10.

Additionally depicted on the figure are a plurality of passages 32, herein the form of generally circular holes passing through the support structures 30*a*, 30*b* which are substantially encased within their respective compressed solid blocks 40*a*, 40*b*. The provision of such passages 32 may permit for improved interconnection between the compressed solid blocks 40*a*, 40*b* and their respective support structures 30*a*, 30*b*.

Figure 6:
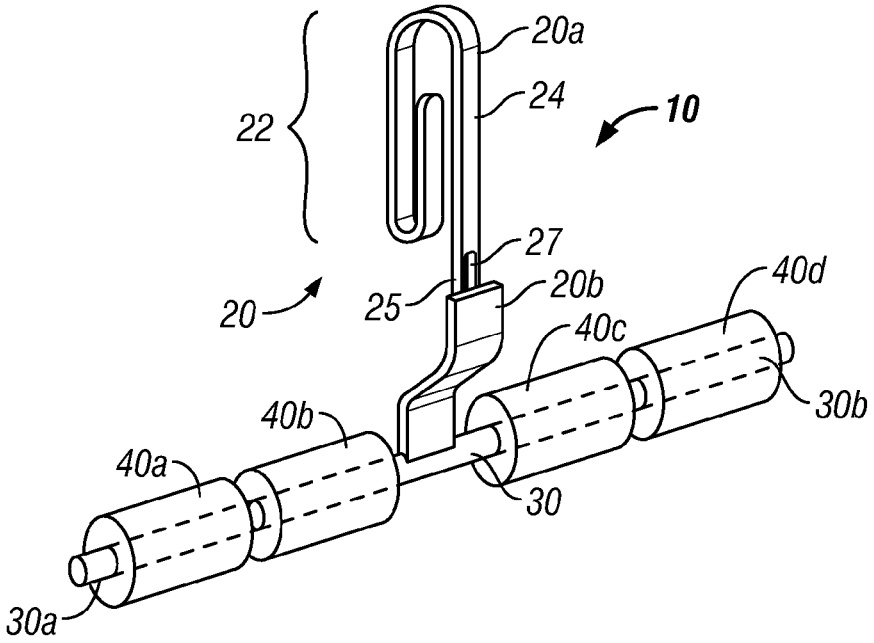

FIG. 6 illustrates a perspective view a still further embodiment a dispensing device 10. In this embodiment, the hanger 20 is formed from two combined elements, an upper hanger element 20*a* which includes a hook 22 and a loop 27 at or near the proximal end 25 thereof, and a lower hanger element 20*b* which is suspended from the upper hanger element 20*a* via latchhook (not shown) which extends through the loop 27 such that the lower hanger element 20*b* which also supports the support structure 30 bearing a plurality of compressed solid blocks 40*a*, 40*b*, 40*c* and 40*d* can be suspended. Such an embodiment depicts a two-part dispensing device 10 wherein a consumer would need to only replace the lower hanger element 20*b* when the compressed solid blocks 40*a*, 40*b*, 40*c* and 40*d* were consumed. And it is visible in the figure, four compressed solid blocks are provided encasing parts 30*a*, 30*b* of the support structure 30. In the embodiment, the support structure 30 has a generally circular cross-section.

Figure 7:
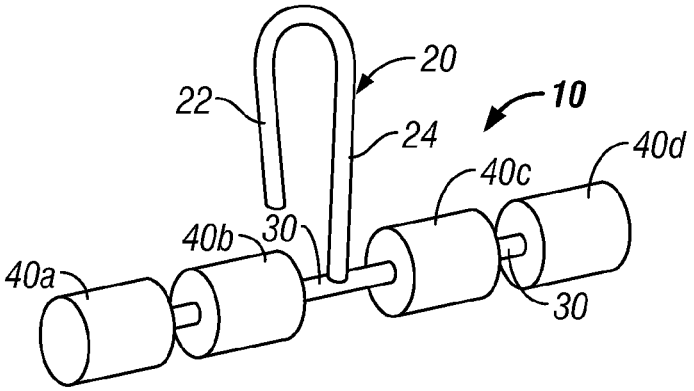

FIG. 7 depicts in a perspective view a single-use type of a dispensing device 10. The hanger 20 is formed of a flexible deformable wire, and includes a hook 22 which to an intermediate stalk 24 is connected to a support structure 30 generally at a midpoint thereof. A plurality of compressed solid blocks 40*a*, 40*b*, 40*c* and 40*d* encase parts of the support structure 30 and depend therefrom. In use, a consumer can conveniently remove the device 10 from a package, and easily bend parts of the hanger 22 any suitable configuration such that the device 10 can be suitably and properly mounted on a lavatory appliance, and particularly be suspended from the rim of a toilet bowl.

Figure 8:
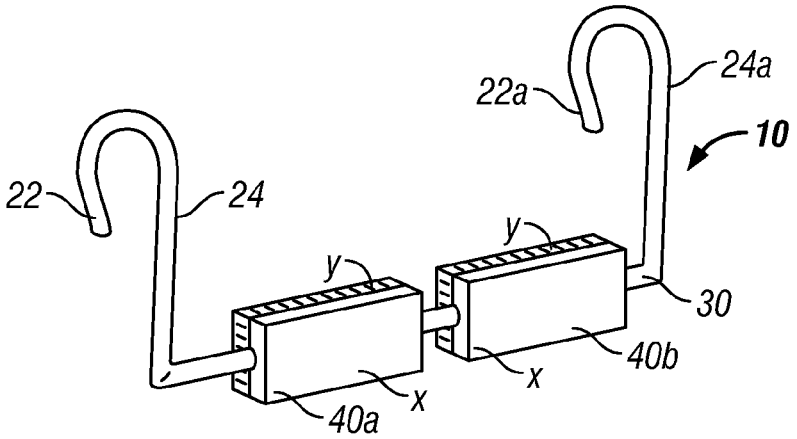

FIG. 8 depicts in a perspective view a still further embodiment of a dispensing device 10 according to the invention which include two hangers 22, 22*a* which are interconnected via respective stalks 24, 24*a* to ends of a support structure 30. Suspended from and depending from the support structure 30 are two compressed solid blocks 40*a*, 40*b* which are of the laminate type. Each of the compressed solid blocks includes two portions, or sections "x" and "y" which have chemically different compositions but which nonetheless are physically adhered to each and other. In the depicted in embodiment, the interface between the two sections "x" and "y" is also coincidentally the point through which the support structure 30 extends however this is not a requirement although it does illustrate a particularly preferred environment which is also readily conveniently fabricated. Provision of such a laminate-type compressed solid blocks permits for the supply of two different and chemically different compressed solid block compositions which may be generally chemically incompatible if intimately mixed with one another, yet in this laminate form wherein separate bodies of these chemically different compressed solid block compositions are merely in an abutting interfacial contact are sufficiently chemically compatible so to be provided in a venerable article.

The support structure 30 is in the depicted embodiment also formed of a bendable wire which is easily configured by a consumer in order to accommodate the specific geometry of a lavatory appliance, particularly a toilet bowl on which the dispensing device 10 is mounted. The wire may be a bare wire formed of a bare metal, or may be a metal or metallic wire which includes a coating such as a sheath or a polymeric coating which may render a more attractive appearance to the wire, and/or also reduce the likelihood of chemical interaction between the wire and the compressed solid blocks 40*a*, 40*b*.

Figure 9:
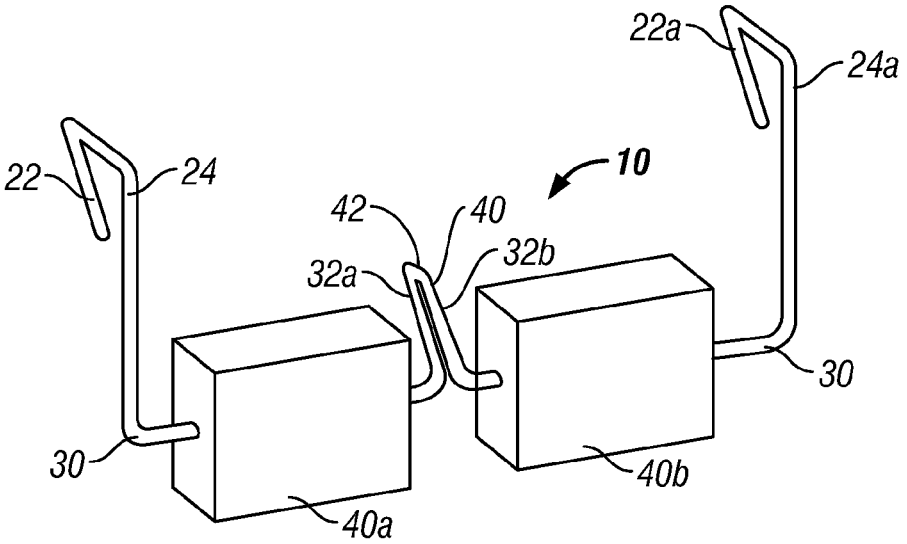

FIG. 9 depicts in a perspective view a yet further embodiment of a dispensing device 10 according to the invention which include two hangers 22, 22*a* which are interconnected via respective stalks 24, 24*a* to ends of a support structure 30, which also includes at or near its midpoint an integrally formed standoff element 40 intermediate two adjacent compressed solid blocks 40*a*, 40*b* which depend from the support structure 30. In this embodiment, the support structure 30 is also advantageously formed of a wire has described with reference to FIG. 8. Further, the support structure 30 includes an integrally formed standoff element 40 formed by a section of the support structure 30 which is bent into two rearwardly extending legs 32*a*, 32*b* which join at and define the peak 42 of the standoff element 40. The direction of the standoff element 40 is advantageously generally in the same direction of the hooks 22 such that when the device 10 is installed on a lavatory appliance, and particularly the rim of a toilet bowl, the hooks can be configured so to suspend the device 10 from the rim of a toilet bowl, and concurrently the peak 42 of the standoff element 40 may come into contact with the inner side wall of a lavatory appliance, especially a toilet bowl such that a gap is maintained between the compressed solid blocks 40*a*, 40*b* and the inner side wall of the lavatory appliance.

Figure 10:
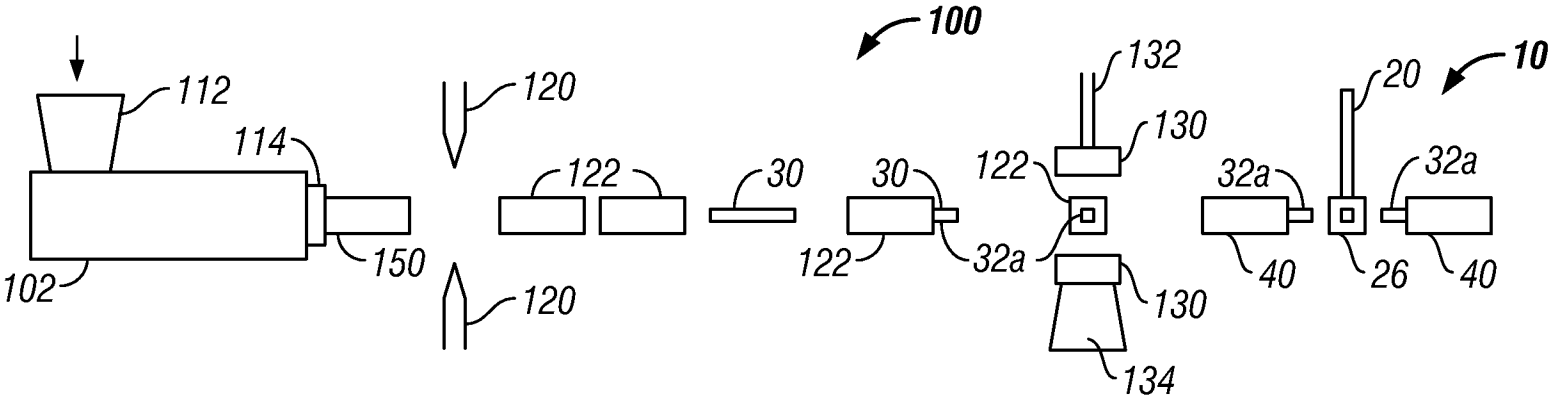

FIG. 10 illustrates a series of process steps which illustrate one embodiment of the improved process for the manufacture of cageless lavatory devices disclosed herein.

With reference to FIG. 10, thereon is depicted by virtue of schematic representations a process 100 for the manufacture of cageless lavatory devices disclosed herein.

Figure 12:
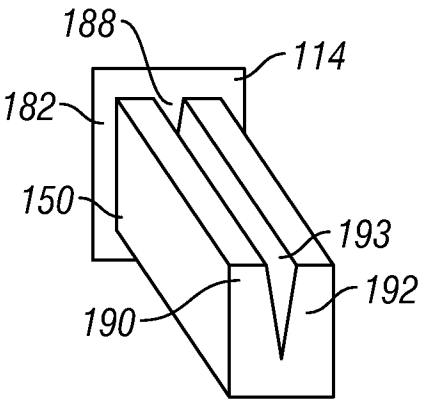
Figure 11:
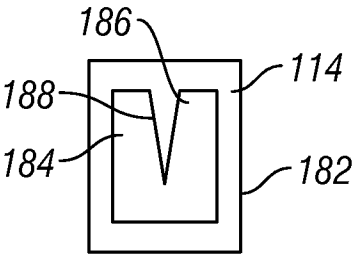

In accordance with the process, a premixed block composition or alternately the constituents required to form a block composition is provided to the inlet hopper 112 of an extruder 102. The extruder may be a single screw extruder or a multiple screw extruder. Where plural screws are present, the screws may be co-rotating or may be counter-rotating. If not previously mixed or blended prior to introduction into the extruder, the block composition is formed into a generally homogeneous mass and exits the extruder via a suitable die 114 which has an orifice profile of suitable dimensions. Advantageously the die has a configuration as generally depicted on FIG. 11. After exiting the die 114, measured lengths or measured masses of the extrudate 150 are separated such as by cutting using a cutting blade or chain cutter 120 into preforms 122 of uncompressed solid block compositions approximately like dimensions and/or mass.

Wherein the die does not shape the extrudate to include a cavity, channel or recess within the extrudate of suitable dimensions to accept at least a part of a hanger, preferably a part of a support structure, and process step may be practiced although not illustrated in the figure. In such an additional step a channel cutting means such as a saw, or other cutting, piercing or drilling device is applied to the extrudate or alternately to the preforms in order to split or shape the preform adequately to provide such a suitable sized channel, recess, bore or passage to permit for the insertion of a part of the hanger, and particularly a part of the support structure. Such a channel, passage, bore or recess advantageously extends into the extrudate and/or block and in some embodiments extends longitudinally through the extrudate and/or the block which facilitates convenient positioning of the hanger and/or support structure in the next process step. Alternately, subsequent to extrusion the preforms may be partially split or otherwise provided with a bore, passage or recess using an suitable tool means, such as a plunging blade, pin or drill which may be used to provide a cavity of sufficient width and depth to accommodate at least parts of a hanger and/or support structure Conveniently in the process depicted on FIG. 10, as the extrudate exits the die a channel is provided by extruding through a die which includes a blade or other cutter means which extends into the open cross-section of the die such that as the extrudate exits the die, it is provided with such a channel which partially splits the extrudate into the legs of a "V", which remain attached however at the base of each leg. Such a channel may extend across the length of the preform and through the ends thereof. An exemplary die comprising such a blade is depicted on FIG. 21, and the form of the extrudate passing through the die is illustrated on FIG. 12. Therein is depicted a plan view of a flat die 114 having a die body 182 and a shaped orifice 184 passing therethrough. Extending from one side 186 of the orifice 184 is a cutting member 188, here in the shape of a V-shaped plough which extends into the interior of the shaped orifice 184. Advantageously the cutting member 188 ploughs through the extrudate passing through the die orifice 184 to form an extrudate which is partially split into the legs of a "V" such as is illustrated on FIG. 12. As is seen from FIG. 12, the hot extrudate tends to deform slightly and open up the distance between the two legs 190, 192 of the "V" which is advantageous in that it often facilitates the later insertion of the hanger and/or support structure prior to the die compression step of the process.

In a next process step, a support structure 30 is inserted within the interior of the channel or cavity of a perform 122 such that the support structure 30 is preferably at least partially encased within the interior of the perform 122, however permitting for an end 32*a* to extend outwardly the perform 122.

Optionally prior to introduction of the preform 122 and support structure 30 into a die 130 in the next process step, the die compression step, one or more of the interior surfaces of the die 130 may be sprayed with a mold release material or other lubricant such as mineral oil or a paraffin oil. The die 130 is preferably a pair of opposing dies 130 which when compressed by a suitable compression means, such as a ram 132 and anvil 134 forms an intermediate die cavity of a suitable dimension within which the preform 122 may be placed. Thus, in the die compression step a preform 122 having an inserted hanger is introduced between the opposing dies 130 and the opposing dies 130 are brought together to both form the compressed solid blocks 40 and adhere it to the support structure 30, as well as to densify the composition of the compressed solid block by at least 1.5%, preferably at least 2% more than the density of the extrudate from which the compressed solid block 40 is formed. Advantageously the pressure of the die is at least 500-1500 psi.

Two or more such compressed solid blocks 40 depending from a support structure 30 may be affixed to a hanger 20, such as by partially inserting the end 32*a* into a connector 26 and thereby form a preferred embodiment of a dispensing device 10 according to the invention. The dispensing device 10, viz. a cageless lavatory dispensing device 10 is thus ready for use with a lavatory appliance, or alternately may be packaged in a suitable package in order to form a vendible article.

Figure 13:
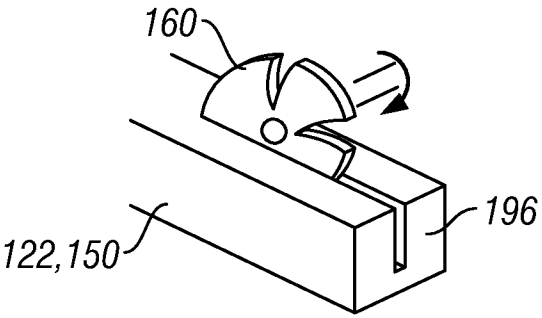

FIG. 13 illustrates a further means for providing a slot or recess to mass of extrudate 150 or to a perform 122. A rotating blade 160 is provides which operates to cut a channel 196 within the extrudate 150 or to a perform 122. Advantageously the dimensions of the channel 196 are such that it is suitably sized to receive a part of a hanger and/or support structure.

Figure 14:
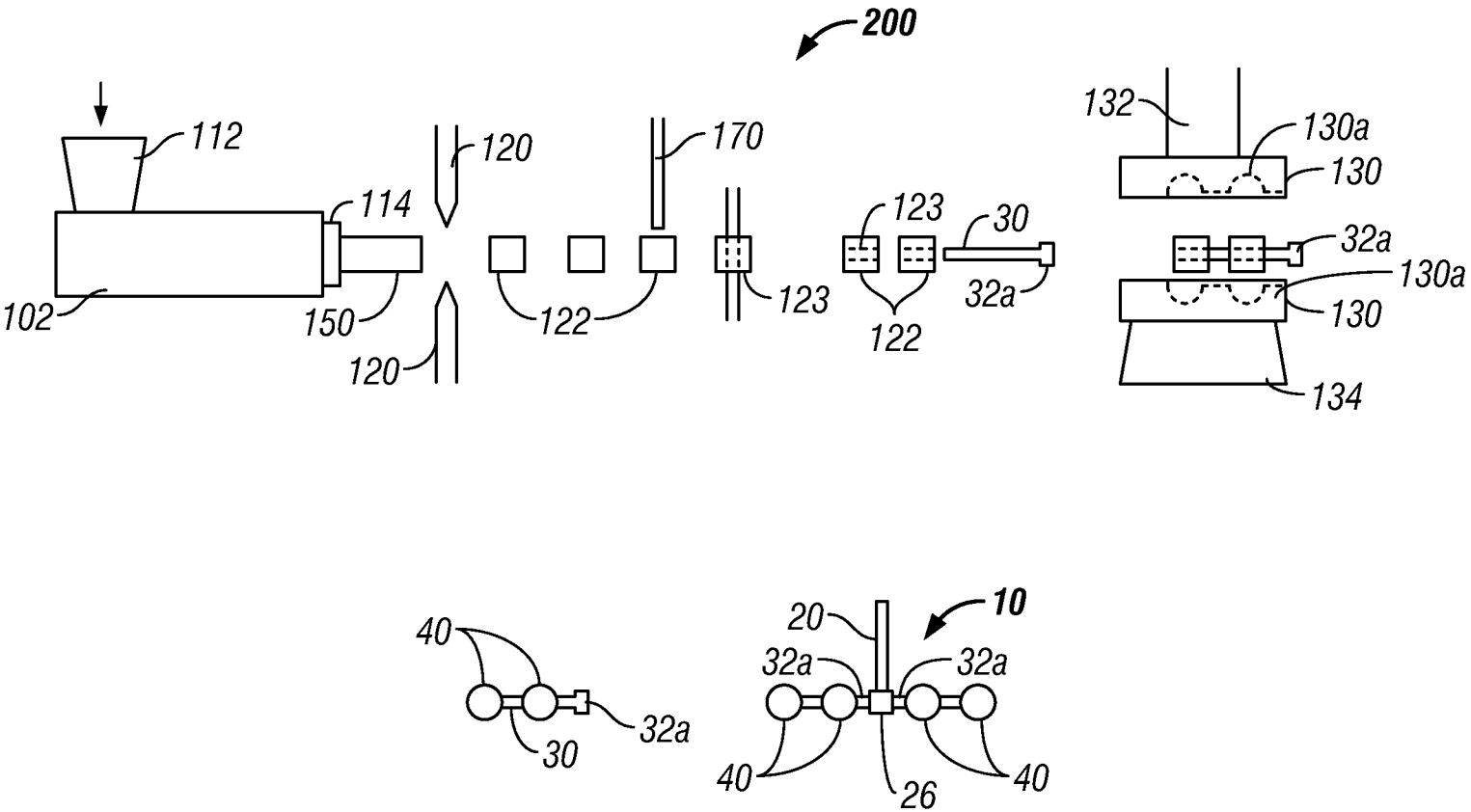

FIG. 14 illustrates a further embodiment of a still further process 200 for the manufacture of cageless lavatory devices disclosed herein.

In accordance with the process 200, a premixed block composition or alternately the constituents required to form a block composition is provided to the inlet hopper 112 of an extruder 102. The extruder may be a single screw extruder or a multiple screw extruder. Where plural screws are present, the screws may be co-rotating or may be counter-rotating. If not previously mixed or blended prior to introduction into the extruder, the block composition is formed into a generally homogeneous mass and exits the extruder via a suitable die 114 which has an orifice profile of suitable dimensions. In the present embodiment the die 114 has a circular, square or rectangular exit orifice (not shown) After exiting the die 114, measured lengths or measured masses of the extrudate 150 are separated such as by cutting using a cutting blade or chain cutter 120 into preforms 122 of uncompressed solid block compositions having approximately like dimensions and/or mass.

As the die 114 does not shape the extrudate to include a cavity, channel or recess within the extrudate of suitable dimensions to accept at least a part of a hanger, preferably a part of a support structure, and bore is provided into or through the preforms 122 by use of a piercing or drilling device 170, respectively a pin and/or a drill which is passed into and/or though extrudate 150 or alternately the preforms 122 in order to shape a passage or bore at least partially or wholly thereto in order to adequately provide such a suitably sized bore or passage to permit for the insertion of a part of the hanger, and particularly a part of the support structure 30 thereinto. Such a passage or bore advantageously extends into the extrudate and/or block and in some embodiments extends longitudinally through the extrudate and/or the block which facilitates convenient positioning of the hanger and/or support structure 30 in the next process step.

In a next process step, a support structure 30 is inserted within the interior of the bore 123 formed within a perform 122 such that the support structure 30 is preferably at least partially encased within the interior of the perform 122, however permitting for an end 32*a* of the support structure 30 to extend outwardly from the perform 122. In the depicted process the support structure 30 in inserted through two preforms 122.

Optionally prior to introduction of the preforms 122 and support structure 30 into a die 130 in the next process step, the die compression step, one or more of the interior surfaces of the die 130 may be sprayed with a mold release material or other lubricant such as mineral oil or a paraffin oil. The die 130 is preferably a pair of opposing dies 130 which when compressed by a suitable compression means, such as a ram 132 and anvil 134 forms an intermediate die cavity of a suitable dimension within which the preform 122 may be placed. In the depicted embodiment, which is provided for by way of illustration and not limitation, the dies 130 include complementary hemispherical cavities 130*a* in order to form the preforms 122 into generally spherical bodies in the die compression step. The opposing dies 130 are brought together to both form the compressed solid blocks 40 and adhere it to the support structure 30, as well as to densify the composition of the compressed solid block by at least 1.5%, preferably at least 2% more than the density of the extrudate from which the compressed solid block 40 is formed. Advantageously the pressure of the die is at least 500-1500 psi.

Two or more such compressed solid blocks 40 depending from a support structure 30 may be affixed to a hanger 20, such as by partially inserting the end 32*a* into a connector 26 and thereby form a preferred embodiment of a dispensing device 10 according to the invention. The dispensing device 10, viz. a cageless lavatory dispensing device 10 is thus ready for use with a lavatory appliance, or alternately may be packaged in a suitable package in order to form a vendible article.

EXAMPLES

Several embodiments of cageless lavatory dispensing devices according to the invention were produced and tested. The compressed solid blocks were all formed from the following composition:

| Test Compressed Solid Composition | % wt./wt. |
|---|---|
| sodium dodecyl benzene sulfonate (85% wt. actives) | 23 |
| sodium $C_{14}$-$C_{16}$ sulfonate (80% wt. actives) | 26.4 |
| sodium sulfate, anhydrous | 42.5 |
| silica, anhydrous | 2 |
| titanium dioxide, anhydrous | 0.1 |
| pigment | 0.0065 |
| fragrance | 4.5 |
| paraffin oil | 1.5 |

which were formed by mixing the constituents, thereafter providing them to an extruder and next compressing performs of the extrudate onto a support structure.

Example 1

A cageless lavatory dispensing device similar to that of FIG. 1 was produced from the foregoing test compressed solid block composition. The device had two compressed solid bocks which had initial masses of 29.98 and 29.88 grams. The device was installed on a toilet such that the hanger was suspended from the rim and the two compressed solid blocks were positioned in the path of flush water which was maintained at room temperature, approx. 20° C. The toilets were operated to automatically flush 12 times daily at 20 minute intervals, after which flushing ceased until the next day which allowed for the blocks to dry during this period. The device was also removed when compressed solid blocks and weighed daily to determine the mass lost. These results are reported on the following Table E1.

TABLE E1

| day | Total mass of compressed solid blocks (grams) |
|---|---|
| initial mass | 54.69 |
| 1 | 52.10 |
| 2 | 49.35 |

TABLE E1-continued

| day | Total mass of compressed solid blocks (grams) |
|---|---|
| 3 | 47.66 |
| 4 | 45.32 |
| 5 | 44.10 |
| 6 | 42.84 |
| 7 | 41.80 |
| 8 | 41.30 |
| 9 | 39.22 |
| 10 | 39.15 |
| 11 | 38.02 |
| 12 | 36.95 |
| 13 | 35.82 |
| 14 | 33.68 |
| 15 | 32.20 |
| 16 | 31.63 |
| 17 | 30.62 |
| 18 | 29.67 |
| 19 | 29.15 |
| 20 | 28.93 |
| 21 | 28.37 |
| 22 | 27.04 |
| 23 | 26.33 |
| 24 | 25.57 |
| 25 | 24.47 |
| 26 | 23.31 |
| 27 | 21.21 |
| 28 | 21.07 |
| 29 | 20.64 |
| 30 | 19.20 |

Throughout the test, the device provided satisfactory foaming to the flush water, throughout the duration of the test which was terminated after 30 day of flushing treatment. It is expected that the device would have an additional useful service life of at least 5 additional days.

Example 2

A cageless lavatory dispensing device similar to that of FIG. 9 was produced from the foregoing test compressed solid block composition. The device had two compressed solid bocks which had initial masses of 29.98 and 29.88 grams. The device was installed on a toilet such that the hanger was suspended from the rim and the two compressed solid blocks were positioned in the path of flush water which was maintained at room temperature, approx. 20° C. The standoff section was used to ensure that a gap was maintained between the compressed solid blocks and the inner sidewall of the toilet bowl. The toilets were operated to automatically flush 12 times daily at 20 minute intervals, after which flushing ceased until the next day which allowed for the blocks to dry during this period. The device was also removed when compressed solid blocks and weighed daily to determine the mass lost. These results are reported on the following Table E2.

TABLE E2

| day | Total mass of compressed solid blocks (grams) |
|---|---|
| initial mass | 59.86 |
| 1 | 58.48 |
| 2 | 57.06 |
| 3 | 55.57 |
| 4 | 54.14 |
| 5 | 53.03 |
| 6 | 51.96 |
| 7 | 51.05 |
| 8 | 50.55 |

TABLE E2-continued

| day | Total mass of compressed solid blocks (grams) |
|---|---|
| 9 | 50.15 |
| 10 | 50.98 |
| 11 | 49.99 |
| 12 | 46.81 |
| 13 | 42.40 |
| 14 | 40.00 |
| 15 | 37.20 |
| 16 | 34.82 |
| 17 | 33.14 |
| 18 | 30.43 |
| 19 | 27.60 |
| 20 | 24.61 |
| 21 | 22.50 |
| 22 | 20.37 |
| 23 | 18.82 |
| 24 | 16.62 |
| 25 | 13.40 |
| 26 | 12.00 |
| 27 | 9.77 |
| 28 | 5.96 |
| 29 | 4.89 |
| 30 | 4.45 |
| 31 | 3.99 |
| 32 | — |

Throughout the test, the device provided satisfactory foaming to the flush water, although the degree of foaming was reduced significantly in the last several days of the test. The compressed solid block compositions were consumed by the 32nd day of the test.

It is to be specifically noted that each of the foregoing tested sample ITB cageless lavatory dispensing devices exhibited a satisfactory service life of the compressed solid block compositions provided with the devices.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A cageless lavatory dispensing device comprising:

a hanger, having a hook end, which is adapted to be suspended from at least part of a rim of a toilet bowl, and depending from the hook end a stalk, a standoff element, and a support structure depending from said stalk, wherein the standoff element is positioned or located with respect to the total length of the hanger as measured from the end of the hook end to the distal end of the hanger, that the standoff element is within the lower half of this total length, and, a plurality of compressed solid blocks formed from an extrudate, wherein said compressed solid blocks comprises at least one chemical agent, which encase or enrobe part of said support structure or stalk and are adapted to be suspended within the interior of the toilet bowl, wherein the standoff element impedes physical contact between the compressed solid blocks and a sidewall of the toilet bowl adjacent to the compressed solid blocks so that a gap is formed between the sidewall and the compressed solid blocks; and, wherein the density of the compressed solid blocks is at least 1% greater than the density of the extrudate; and, wherein the at least one chemical agent is eluted or dissolved into water flushed over the compressed solid blocks and forms a treatment composition which provides a cleaning and/or sanitizing and/or disinfecting benefit to the toilet bowl being treated with the treatment composition.

2. The device according to claim 1 wherein at least one surfactant is present as the at least one chemical agent.

3. The device according to claim 1 wherein the device further includes an air treatment dispenser.

4. The device according to claim 1, wherein the density of the compressed solid blocks is at least 1.5% greater than the density of the extrudate.

5. The device according to claim 1, wherein, in use, the standoff element has a dimension which is sufficient such that when the device is initially installed in a toilet bowl, the height of the standoff element is sufficient to impede physical contact between the blocks and the side wall adjacent to said blocks.

6. The device according to claim 1, wherein the at least one surfactant is present in an amount of at least 25% wt. of at least one of the compressed solid blocks.

7. The device according to claim 6, wherein the at least one surfactant is present in an amount of at least 49% wt. of the compressed solid blocks.

8. The device according to claim 1, wherein at least one of the solid blocks comprises a sanitizing agent.

9. The device according to claim 8, wherein the sanitizing agent is selected from: materials containing alkyl halohydantoins, alkali metal haloisocyanurates, bleach, essential oils, quaternary ammonium germicidal compounds and non-quaternary ammonium germicidal compounds.

10. The device according to claim 1, wherein at least one of the compressed solid blocks comprises an anti-limescale agent.

11. The device according to claim 1, wherein at least one of the compressed solid blocks comprises a hydrocarbon solvent constituent.

12. The device according to claim 11, wherein the at least one of the compressed solid blocks comprises paraffin oil.

13. The device according to claim 1, wherein at least one of the compressed solid blocks include a water-soluble film coating.

14. The device according to claim 1, wherein the standoff element is positioned or located within the lower 40% of the total length of the hanger as measured from the end of the hook end, to the distal end of the hanger.

15. The device according to claim 14, wherein the standoff element is positioned or located within the lower 33% of the total length of the hanger as measured from the end of the hook end, to the distal end of the hanger.

16. The device according to claim 1, wherein the standoff element depends from the stalk of the hanger.

17. A cageless lavatory dispensing device comprising:

a hanger having a hook end, a stalk depending from said hook end, a first support structure depending from said stalk and a second support structure also depending from said stalk, said hanger is adapted to be suspended from at least a part of the rim of a toilet bowl, and, a plurality of compressed solid blocks formed from an extrudate, with at least one of said compressed solid blocks encasing or enrobing a part of said first support structure, and at least one further of said compressed blocks encasing or enrobing a part of said second support structure, wherein each of said compressed solid blocks comprises at least one chemical agent, and wherein each of said compressed blocks are adapted to be suspended within the interior of the toilet bowl wherein a portion of said support structure or stalk is a stand off element which impedes physical contact between the compressed solid blocks and a sidewall of the toilet bowl adjacent to the compressed solid blocks so that a gap is formed between the sidewall and the compressed solid blocks; and, wherein the density of the compressed solid blocks is at least 1% greater than the density of the extrudate; and, wherein the at least one chemical agent is eluted or dissolved into water flushed over the compressed solid blocks and forms a treatment composition which provides a cleaning and/or sanitizing and/or disinfecting benefit to the toilet bowl being treated with the treatment composition.

18. The device according to claim 17 wherein the hanger further includes a connector which is affixable to parts of each of the first support structure and the second support structure.

19. The device according to claim 17 wherein the first support structure and the second support structure are colinear and perpendicular to an axis of the stalk.

20. The device according to claim 17, wherein the chemical compositions of the compressed solid blocks encasing or enrobing a part of said first support structure, and the at least one further of said compressed blocks encasing or enrobing a part of said second support structure are different from one another.

21. The process for delivering a treatment composition to the interior of a toilet bowl, which process comprises:

providing a cageless lavatory dispensing device according to claim 1, suspending the compressed solid blocks within the toilet bowl, and, periodically flushing water about the exterior of the compressed solid blocks to elute the at least one surfactant to form a treatment composition with said water, which treatment composition provides a cleaning and/or sanitizing and/or disinfecting benefit to the toilet bowl.

* * * * *